US009610629B2

(12) United States Patent
Shinbutsu et al.

(10) Patent No.: US 9,610,629 B2
(45) Date of Patent: Apr. 4, 2017

(54) ROLLING MACHINE AND METHOD OF ROLLING GEAR USING THE ROLLING MACHINE

(71) Applicant: NISSEI CO., LTD., Yamanashi (JP)

(72) Inventors: Toshinaka Shinbutsu, Yamanashi (JP); Shuichi Amano, Yamanashi (JP); Shinya Hasegawa, Yamanashi (JP); Hiroshi Sasaki, Yamanashi (JP); Shoichi Usunami, Yamanashi (JP)

(73) Assignee: NISSEI CO., LTD., Yamanashi (JP)

( * ) Notice: Subject to any disclaimer, the term of this patent is extended or adjusted under 35 U.S.C. 154(b) by 0 days.

(21) Appl. No.: 14/906,553

(22) PCT Filed: Jul. 23, 2014

(86) PCT No.: PCT/JP2014/069497

§ 371 (c)(1),
(2) Date: Jan. 21, 2016

(87) PCT Pub. No.: WO2015/012330

PCT Pub. Date: Jan. 29, 2015

(65) Prior Publication Data

US 2016/0175916 A1 Jun. 23, 2016

(30) Foreign Application Priority Data

Jul. 23, 2013 (JP) ..... 2013-153029

(51) Int. Cl.
*B21H 5/00* (2006.01)
*B21H 5/02* (2006.01)

(52) U.S. Cl.
CPC ..... *B21H 5/02* (2013.01)

(58) Field of Classification Search
CPC ..... B21H 1/00; B21H 5/00; B21H 5/02
See application file for complete search history.

(56) References Cited

U.S. PATENT DOCUMENTS 4,950,112 A * 8/1990 Huber ..... B23F 19/06 409/32
2001/0039820 A1* 11/2001 Shinbutsu ..... B21H 1/00 72/108

FOREIGN PATENT DOCUMENTS

CN 88100946 12/1986
JP S47-33048 11/1972
(Continued)

OTHER PUBLICATIONS

"International Search Report (Form PCT/ISA/210)", mailed on Sep. 22, 2014, pp. 1-5, in which seven of the listed references (JP11-285765, JP59-85338, JP2005-028365, JP2000-018362, JP03-140659, JP55-131430 and JP2013-510001) were cited.
(Continued)

*Primary Examiner* — Teresa M Ekiert
(74) *Attorney, Agent, or Firm* — Jianq Chyun IP Office

(57) ABSTRACT

Provided is a rolling machine including a plurality of cylindrical round dies disposed centering on a cylindrical raw material to roll the raw material from the outer circumference of the raw material. In order to adjust the turning angle in the inclined shaft (the A shaft) turned around the push-in direction (the X axis) of the round die (3), an inclined-shaft control motor is started to turn a round die table (21) on the A shaft. A B-shaft control motor (71) is driven in order to adjust the turning angle on the taper shaft (the B shaft) turned around the Y axis orthogonal to the push-in direction and orthogonal to the axis of the raw material. According to the adjustment of the A shaft and the B shaft, it is possible to correct a tooth trace and a tooth shape of a gear.

11 Claims, 20 Drawing Sheets

(56) References Cited

FOREIGN PATENT DOCUMENTS

| | | |
|---|---|---|
| JP | S48-38544 | 11/1973 |
| JP | S49-25551 | 7/1974 |
| JP | 55-131430 | 10/1980 |
| JP | 59-85338 | 5/1984 |
| JP | S60-71115 | 4/1985 |
| JP | H02-66916 | 3/1990 |
| JP | 03-140659 | 6/1991 |
| JP | 11-285765 | 10/1999 |
| JP | 2000-018362 | 1/2000 |
| JP | 2005-028365 | 2/2005 |
| JP | 2013-510001 | 3/2013 |
| WO | 03/000442 | 1/2003 |

OTHER PUBLICATIONS

"Office Action of China Counterpart Application", issued on Sep. 29, 2016, p. 1-p. 6, in which the listed reference was cited.

* cited by examiner

ROLLING MACHINE AND METHOD OF ROLLING GEAR USING THE ROLLING MACHINE

CROSS-REFERENCE TO RELATED APPLICATION

This application is a 371 application of the international PCT application serial no. PCT/JP2014/069497, filed on Jul. 23, 2014, which claims the priority benefit of Japan application no. 2013-153029, filed on Jul. 23, 2013. The entirety of each of the above-mentioned patent applications is hereby incorporated by reference herein and made a part of this specification.

TECHNICAL FIELD

The present invention relates to a rolling machine and a method of rolling a gear using the rolling machine. More specifically, the present invention relates to a rolling machine that enables various components to be manufactured by rolling and a rolling machine that corrects a tooth trace and the like of the gear with the rolling machine and a method of rolling a gear using the rolling machine.

BACKGROUND ART

In general, in gear machining by a machine tool, after machining by cutting, grinding, and the like, a pitch error, a tooth shape error, a tooth trace (a crossing line of a tooth surface and a pitch surface) error, and the like of the gear are measured by a gear measuring device, an error due to the machine tool or a tool is found by data of the measurement, and the machine tool or the tool is correctly adjusted. Usually, when a gear is molded through rolling by a round die, after trial rolling, the rolled gear is measured by a gear measuring device, the round die is redesigned and reground according to an error obtained by the measurement, and a desired tooth shape of the gear is obtained with high accuracy.

There are various profile deviations of gears. Helix deviations are specified by the Japan Industrial Standard (JIS) as well. By measuring helix deviations in the gear measuring device, for example, in the case of a spur gear, it is possible to measure an error of formation of a lead inclining with respect to a spur gear center axis by a helix, an error of tapering of the helix, and the like. With the gear measuring device, it is also possible to measure a shape of a crowning in which both ends of the spur gear are formed as slight curved surfaces to be thinned. To correct these errors and the like, clamp bolts for fixing a supporting table, a turning table, and the like, which support the round die, are loosened, an angle is adjusted by an angle adjustment screw, and turning angles and positions of the supporting table, the turning table, and the like are adjusted in order to adjust a turning angle on an inclined shaft (an A shaft) turned around a pushing-in direction (an X axis) for pushing in the round die and a turning angle on a taper shaft (a B shaft) turned around a Y axis. That is, an operator alternately repeats work for adjusting an attachment angle, a position, and the like of the round die and performing trial turning again to modify a desired helix.

When the turning angles are adjusted, since the turning angles are very small angles and the mass of the supporting table is large and a frictional force is also large, as adjustment for moving the supporting table, fine adjustment is difficult because a load of the supporting table is large and the supporting table easily bends. The adjustment needs to be performed by operating a clamp bolt, an angle adjustment screw, a position adjustment screw, and the like with a technique and a skill of a skilled person. The accurate angle adjustment and position adjustment are not easy for a non-skilled person. Conversely, it is also likely that an error is caused because the inclined shaft (the A shaft) and the taper shaft (the B shaft) can be moved and adjusted. There is a demand for development of a rolling machine that can facilitate adjustment of the inclined shaft (the A shaft) and the taper shaft (the B shaft) and can perform adjustment of a helix, a profile, and the like actively making use of an adjustment function. On the other hand, the applicant proposed a structure including four columnar guide surfaces in a guiding section (a guide section) in order to avoid, as much as possible, deformation of a machine body during rolling by a round die to which a high load is applied (see Patent Literature 1). In general, in a rolling machine by a round die, to avoid deformation of a supporting table that supports the round die, a bar material for deformation prevention called stay bolt is laid over in an upper part between left and right supporting tables.

The four guiding sections of the rolling machine or a stay bolt structure has a drawback in that a raw material, which is a workpiece to be rolled, is prevented from being carried in/out because the guiding sections or the stay bolt becomes an obstacle. However, for the rolling machine for the gear, it is undesirable to remove the guiding sections or the stay bolt to reduce the rigidity of the machine body. Further, these rolling machines are not always optimum as the rolling machine for the gear. That is, these rolling machines have an angle adjusting function in the taper shaft (the B shaft) direction important for the rolling of the gear but are manually adjusted and do not have an automatic adjustment function. In the machining of the gear by the rolling machine in the past, a tooth surface and the like of the gear to be rolled are different in a position in an axial direction. Therefore, in order to correct the difference, there has been proposed a method of adjusting a shape error of the tooth surface in the axial direction by regularly and reversely rotating the round die (see Patent Literature 2). This method has a drawback in that a machining time is long because the round die is reversely rotated. The method equalizes the shape error in the axial direction and cannot perform fine adjustment.

CITATION LIST

Patent Literature

[PTL 1] Japanese Patent Application Laid-Open No. H11-285765

[PTL 2] WO2003/000442 A1

SUMMARY OF INVENTION

Technical Problem

The present invention has been devised in view of the circumstances in the past and attains objects described below.

It is an object of the present invention to provide a rolling machine that can adjust, with a control motor mechanism, a turning angle on an inclined shaft (an A shaft) turned around a push-in direction (an X axis) of a round die and a turning angle on a taper shaft (a B shaft) turned around a Y axis.

It is another object of the present invention to set a position of a guide surface high and provide a rolling machine having high rigidity.

It is still another object of the present invention to provide a method of rolling a gear using, in order to correct a helix deviations, a profile deviation, and the like of the gear, a rolling machine that can adjust a turning angle on an inclined shaft (an A shaft) turned around a push-in direction (an X axis) of a round die and a turning angle on a taper shaft (a B shaft) turned around a Y axis.

Solution to Problem

In order to solve the problems, the prevent invention adopts means described below.

A rolling machine according to the present invention 1 is a rolling machine including: a plurality of cylindrical round dies disposed centering on a raw material, which is a workpiece, to roll the raw material from the outer circumference of the raw material; die-rotation driving means for driving to rotate the round dies; raw material supporting means for rotatably supporting the raw material; and push-in means for bringing the round dies close to each other from the outer circumference toward the raw material and pushing in the round dies while rotating the round dies in the same direction in synchronization with each other, the rolling machine further including: a B-shaft swinging table that swings on a taper shaft (a B shaft) turning around a Y axis orthogonal to a push-in direction (an X axis) of the round dies; a die table that swings on an inclined shaft (an A shaft) turning around the push-in direction (the X axis) of the round dies on the B-shaft swinging table; taper-shaft adjusting means for adjusting a swing angle of the B-shaft swinging table on the taper shaft (the B shaft); and inclined-shaft adjusting means for adjusting a swing angle of the die table on the inclined shaft (the A shaft).

In the rolling machine according to the present invention 2, in the present invention 1, one of the round dies is mounted on a fixed headstock fixed on a bed, the other of the round dies is mounted on a moving headstock that moves on the bed, and guiding means on the bed of the moving headstock is a plurality of linear guide mechanisms (7, 7, 9) having different heights in the vertical direction.

In the rolling machine according to the present invention 3, in the present invention 1 or 2, the inclined-shaft adjusting means and the taper-shaft adjusting means are means for correcting a helix and/or a profile of a gear.

In the rolling machine according to the present invention 4, in the present invention 2, the plurality of linear guide mechanisms (7, 7, 9) are disposed at an equal distance from a position of a power point in the push-in direction.

The rolling machine according to the present invention 5 includes, in the present inventions 1 to 4, work-rotation driving means for rotating the raw material in synchronization with the rotation driving of the round dies to control driving of rotation of the raw material around the axis of the raw material.

In the rolling machine according to the present invention 6, in the present inventions 1 to 4, the inclined-shaft adjusting means and/or the taper-shaft adjusting means includes a screw shaft (105) driven by a numerically rotation-angle-controllable motor (103) disposed on a fixed side, and is configured to bring a cam member (101), which operates integrally with a moving object (107, 405) movable in the axial direction according to rotation of the screw shaft (105), into contact with the die table (108) or the B-shaft swinging table (60, 801) to numerically adjust a direction of the round dies.

In the rolling machine according to the present invention 7, in the present inventions 1 to 4, the inclined-shaft adjusting means and/or the taper-shaft adjusting means includes a shaft (76, 113, 802) driven to rotate by a numerically rotation-angle-controllable motor (71, 112) disposed on a fixed side, and is configured to bring an eccentric cam member (77, 111, 804*a*, 804*b*), which operates according to the rotation driving of the shaft (76, 113, 802), into contact with a cam follower (78, 109, 806*a*, 806*b*) integral with the die table (21) or the B-shaft swinging table (60, 801) to numerically adjust a direction of the round dies.

In the rolling machine according to the present invention 8, in the present inventions 1 to 4, the inclined-shaft adjusting means and/or the taper-shaft adjusting means includes gear transmission means (304, 305, 311, 312) driven by a numerically rotation-angle-controllable motor (303, 307) disposed on a fixed side, and is configured to rotate the die table (301) or the B-shaft swinging table (60) according to a rotating motion of the gear transmission means (304, 305, 311, 312) to numerically adjust a direction of the round dies.

In the rolling machine according to the present invention 9, in the present inventions 1 to 4, the inclined-shaft adjusting means and/or the taper-shaft adjusting means includes a screw shaft (504) driven by a numerically rotation-angle-controllable motor (502) disposed on a fixed side, includes a taper member (506, 508) screwed into the screw shaft (504) and capable of advancing and retracting according to rotation of the screw shaft (504), and is configured to press the die table (507) or the B-shaft swinging table (60) according to a moving motion of the taper member (506, 508) to numerically adjust a direction of the round dies.

In the rolling machine according to the present invention 10, in the present inventions 1 to 4, the inclined-shaft adjusting means and/or the taper-shaft adjusting means includes a shaft (605, 707) driven by a numerically rotation-angle-controllable motor (603, 705) disposed on a fixed side, is provided with, in the shaft (605, 707), two eccentric members (601, 703*a*, 703*b*) coming into contact with the die table (608, 701*a*, 701*b*) and spaced apart in the axial direction, and is configured to rotate the eccentric members (601, 703*a*, 703*b*) according to rotation of the shaft (605, 707) to change an eccentric distance, and press the die table (608, 701*a*, 701*b*) or the B-shaft swinging table (60) to numerically adjust a direction of the round dies.

A method of rolling a gear by a rolling machine according to the present invention 11 is a method of rolling a gear by a rolling machine including: a plurality of cylindrical round dies disposed centering on a raw material, which is a workpiece, to roll the raw material from the outer circumference of the raw material; die-rotation driving means for driving to rotate the round dies; raw material supporting means for rotatably supporting the raw material; and push-in means for bringing the round dies close to each other toward the raw material and pushing in the round dies while rotating the round dies in the same direction in synchronization with each other, the method including: adjusting, in order to correct a helix and/or a profile of the gear, a turning angle on an inclined shaft (an A shaft) turned around a push-in direction (an X axis) of the round dies; and adjusting a turning angle on a taper shaft (a B shaft) turned around a Y axis orthogonal to the axis of the raw material.

In the method of rolling the gear by the rolling machine according to the present invention 12, in the present invention 11, the raw material is rotated in synchronization with the rotation driving of the round dies and controlled to be driven.

Advantageous Effects of Invention

In the rolling machine and the method of rolling the gear using the rolling machine according to the present invention, the turning angle on the inclined shaft (the A shaft) turned around the push-in direction (the X axis), which is a direction in which the round dies are pushed in, and the turning angle on the taper shaft (the B shaft) turned around the Y axis can be adjusted by the control motor (a servo motor). Therefore, even a non-skilled person can perform fine and highly accurate adjustment. The moving headstock is guided by a plurality of guide rails having different heights. The guide rails are disposed at an equal distance from a rolling center position (a power point position). Therefore, it is possible to obtain the rolling machine having high rigidity during rolling. The rolling machine can perform fine and highly accurate angle adjustment in the inclined shaft (the A shaft) and the taper shaft (the B shaft). Therefore, the rolling machine is suitable for correcting a helix of the gear.

DESCRIPTION OF EMBODIMENTS

Figure 1:
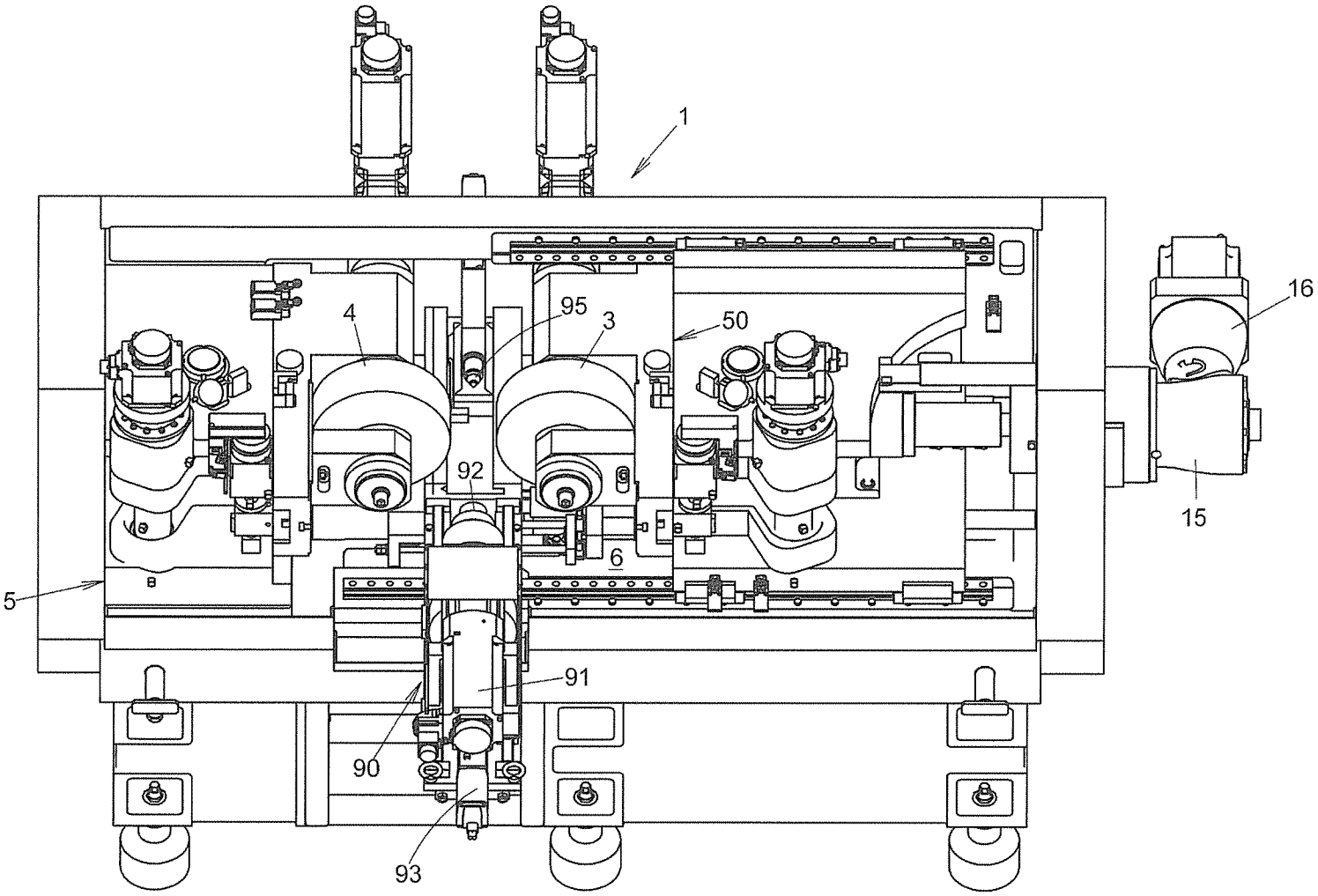
FIG. 1 is an exterior view showing the exterior of an entire rolling machine.
Figure 2:
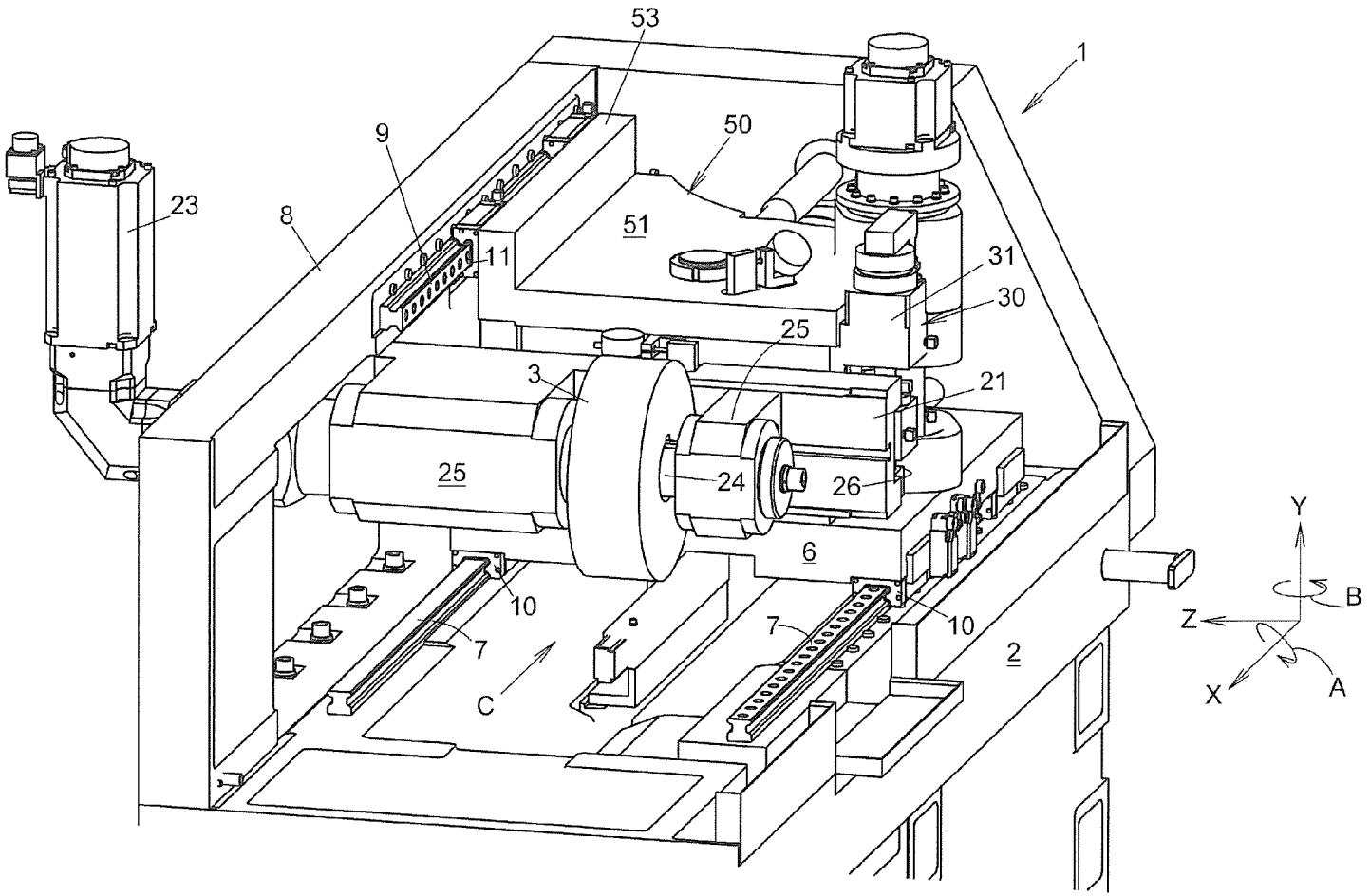
FIG. 2 is an exterior view showing the exterior of a moving headstock during moving.
Figure 3:
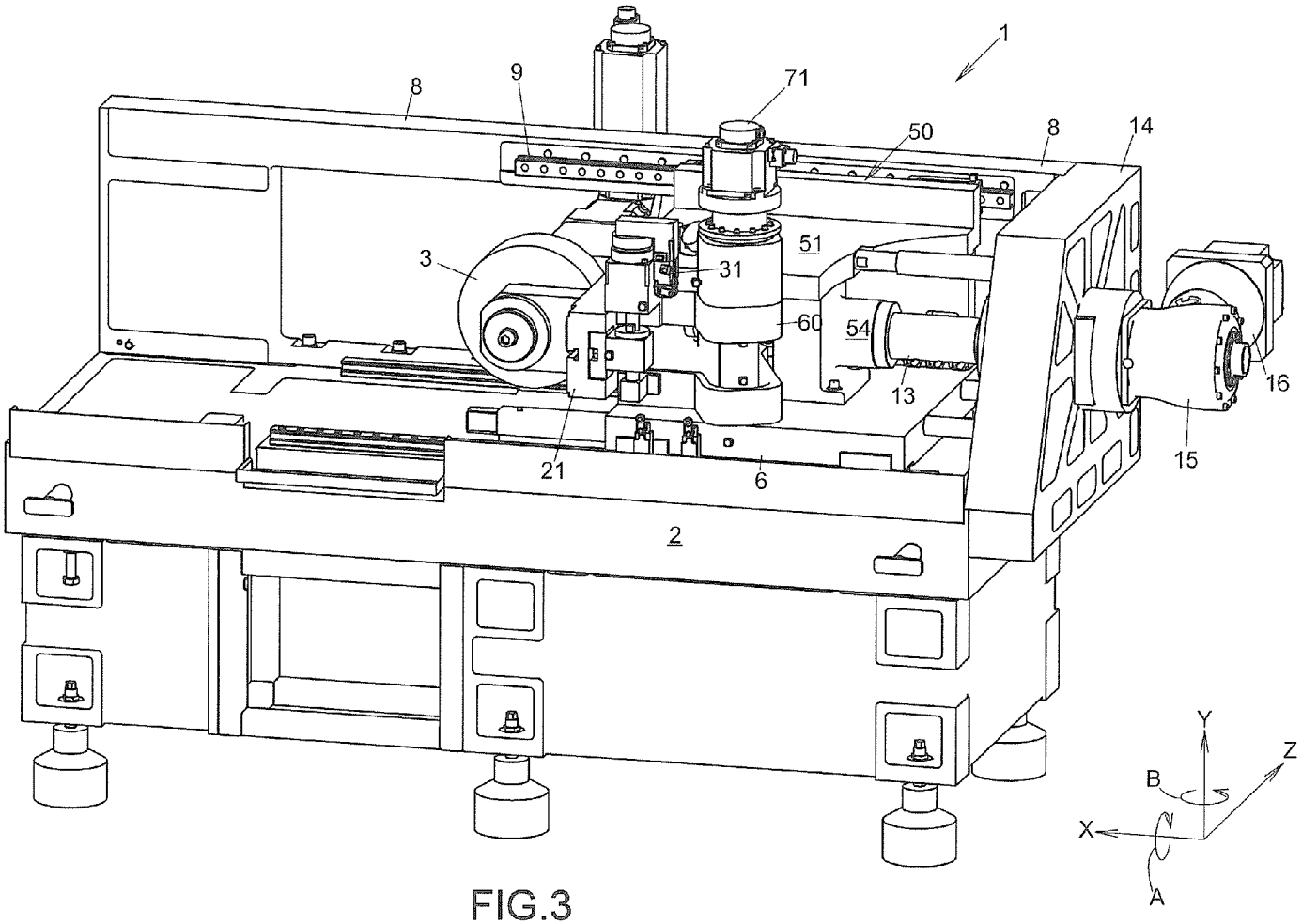
FIG. 3 is a diagram showing the exterior of a feed driving mechanism that drives the moving headstock mounted with a round die in an X-axis direction.
Figure 4:
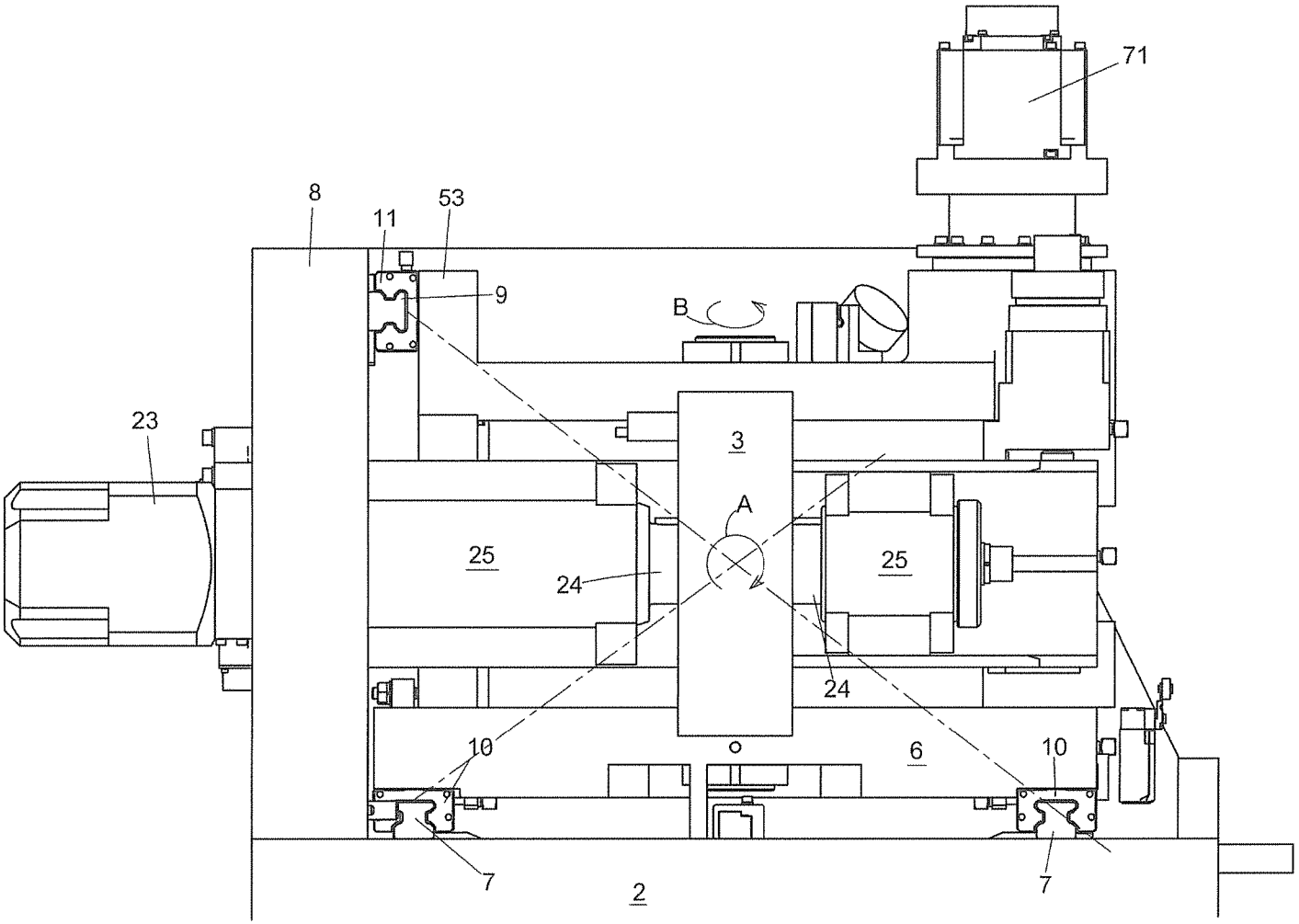
FIG. 4 is a front view of the moving headstock viewed from a C direction in FIG. 2.

A rolling machine 1 according to an embodiment of the present invention is explained below with reference to the drawings. FIG. 1 is an exterior view showing the exterior of the entire rolling machine 1. FIG. 2 is an exterior view showing the exterior of a moving headstock. FIG. 3 is a diagram showing the exterior of a feed driving mechanism that drives the moving headstock in an X-axis direction. FIG. 4 is a front view of the moving headstock viewed from a C direction in FIG. 2. As shown in FIG. 1, a round die 3, which is a tool for rolling, is mounted on a moving headstock 50 on a bed 2 set on a floor and made of a casting. A fixed headstock 5 is mounted and fixed on the bed 2 to be opposed to the round die 3. On the fixed headstock 5, a round die 4 not moving in the X-axis direction (a push-in direction, which is a direction in which the round die 3 is pushed in) is mounted. In this example, a gear is rolled by two tools, that is, the round die 3 and the round die 4.

[Moving Headstock 50]

The round die 3 is mounted on the moving headstock 50. Two linear guide rails 7 are fixedly disposed at an interval on the upper surface of the bed 2 (see FIG. 2). A slider (a movable member) 10 incorporating a rolling member is fixedly disposed on the lower surface of a lower frame 6, which configures the moving headstock 50. A linear guide mechanism is configured by the linear guide rails 7 and the slider 10. The lower frame 6 is guided by the slider 10 to be movable on the two linear guide rails 7. A side-surface guiding section 53 is fixed on one side surface of the lower frame 6 integrally with the side surface. An upper frame 51 is integrally provided and fixed in the side-surface guiding section 53. Eventually, the lower frame 6, the side-surface guiding section 53, and the upper frame 51 configure a main body frame of the moving shaft table headstock 50.

On the other hand, a rectangular sub-bed 8 is erected and disposed on a sideward side of the upper surface of the bed 2. A lower part of the sub-bed 8 is fixed by bolts or the like and provided integrally with the bed 2. The sub-bed 8 faces the side-surface guiding section 53, which configures the moving headstock 50 on the lower frame 6. On a side surface of the sub-bed 8, a linear guide rail 9 is disposed and fixed in parallel to the linear guide rails 7 on the bed 2. A slider (a movable member) 11 is provided on a side surface of the side-surface guiding section 53 and is guided by the linear guide rail 9 disposed on the sub-bed 8 to reciprocatingly move. A linear guide mechanism is configured by the linear guide rail 9 and the slider 11. The moving headstock 50 is guided by the two linear guide rails 7 disposed on the same plane and the one linear guide rail 9 disposed on a surface perpendicular to the plane.

Eventually, the moving headstock 50 is guided by three sets of linear guide mechanisms in total configured by the two linear guide rails 7 and the slider 10 on the bed 2 and the one linear guide rail 9 and the slider 11 on the sub-bed 8. This means that the moving headstock 50 is guided by two surfaces orthogonal to each other, and the moving headstock 50 has high rigidity against a rolling pressure. According to the guide by these linear guide mechanisms, the moving headstock 50 is capable of reciprocatingly moving in the X-axis direction. As shown in FIG. 4, the linear guide rail 9 is disposed in a height position different from the height position of the two linear guide rails 7. Therefore, even if the rolling pressure acts on the moving headstock 50, since the linear guide rail 9 is guided and supported at three points (lines), the linear guide rail 9 has a structure unlikely to be deformed and therefore few rolling errors occur in the linear guide rail 9. That is, the linear guide mechanisms are disposed in positions at an equal distance from a power point (a rolling center position) in the X-axis direction at the time when rolling is performed on a raw material by the round die 3 and the round die 4. The linear guide rail 9 and the two linear guide rails 7 are respectively disposed at an equal distance from the power point position. Therefore, even if the moving headstock 50 receives the reaction of the rolling pressure, the moments of the reaction have substantially the same magnitude and thus there is an effect of reducing deformation.

Since the moving headstock 50 is guided at three points during the movement, movement in the X-axis direction is also stable. Further, on an operation side of the rolling machine 1, a linear guide mechanism for reinforcement or guide for the moving headstock 50 is absent. Therefore, there is no obstacle in carrying in/out a raw material and the like. FIG. 3 is an exterior view showing a rear part of the moving headstock 50. The moving headstock 50 receives a push-in force at the time of rolling. A ball nut 13 is fixed on a back side of the moving headstock 50. The ball nut 13 is screwed into a screw section of a ball screw (not shown in the figure). The center line of the ball nut 13 and the ball screw is in the X-axis direction. The center line position of the ball screw coincides or substantially coincides with the position of the power point. An X-axis driving mechanism fixing table 14 is disposed at the rear end of the bed 2. The lower end portion of the X-axis driving mechanism fixing table 14 is screwed to the rear end of the bed 2. At the same time, a side surface of the X-axis driving mechanism fixing table 14 is fixed to the rear end of the sub-bed 8 by bolts or the like.

The bed 2, the sub-bed 8, and the X-axis driving mechanism fixing table 14 are integral and configure a machine body, which is a main body of the rolling machine 1. The machine body has high rigidity because the machine body forms a box shape with three surfaces thereof opened. Since the upper surface and the front surface are opened, the machine body does not hinder operation by an operator and does not hinder carrying-in and carrying-out of a machining raw material. A transmission 15 incorporating a gear transmission mechanism is disposed and mounted on the rear end face of the X-axis driving mechanism fixing table 14. An output shaft of the transmission 15 is coupled to the rear end of the ball screw. An input shaft of the transmission 15 is coupled to an output shaft of the X-axis control driving motor 16. These transmission driving mechanisms are publicly-known techniques and detailed explanation thereof is omitted. When the X-axis control driving motor 16 is driven to rotate, the output shaft of the transmission 15 drives the ball screw to rotate. When the ball screw is driven to rotate, rotation in a rotating direction of the ball nut 13 screwed in the ball screw is regulated. Therefore, the ball nut 13 is pushed or pulled in the X-axis direction. The moving headstock 50 is guided by the two linear guide rails 7 and the one linear guide rail 9 to be capable of reciprocatingly moving in the X-axis direction.

The round die 3 is mounted on a round die table 21 disposed on the front surface of the moving headstock 50. A rotation driving control motor 23 is mounted on a side part of the round die table 21. A reduction gear (not shown in the figure) is coupled between the rotation driving control motor 23 and a round die shaft 24. In this example, the reduction gear is incorporated in the rotation driving control motor 23. The round die shaft 24 is coupled to an output shaft of the reduction gear. The round die 3 is attached to the round die shaft 24 and fixed by a key during rolling. Both ends of the round die shaft 24 are rotatably supported on a bearing supporting table 25 and supported by a bearing disposed on the inside of the bearing supporting table 25. The bearing supporting table 25 is mounted and fixed on the round die table 21. Therefore, the round die 3 is driven to rotate on the round die table 21 by the rotation driving control motor 23 and the built-in reduction gear.

[Inclined-Shaft Adjusting Means (A Shaft) 30]

The round die table 21 is capable of turning in the push-in direction (the X axis) of the round die 3, that is, around an inclined shaft (an A shaft) shown in FIG. 4. Therefore, the round die 3 on the round die table 21 is capable of turning in the inclined shaft (the A shaft) on the lower frame 6 as shown in FIG. 4. Inclined-shaft adjusting means (A shaft) 30 in this embodiment means angle adjusting means for adjusting, with power according to control, a turning angle on the inclined shaft (the A shaft) turning around the push-in direction (the X axis) of the round die 3. The structure of the inclined-shaft adjusting means 30 is explained below. A shaft 63 is provided on the front surface of a B-shaft swinging table 60 on the moving headstock 50 (see FIG. 8). A rear part of the round die table 21 is attached to the shaft 63. The round die table 21 is turnable around the shaft 63 (the A shaft).

Figure 5:
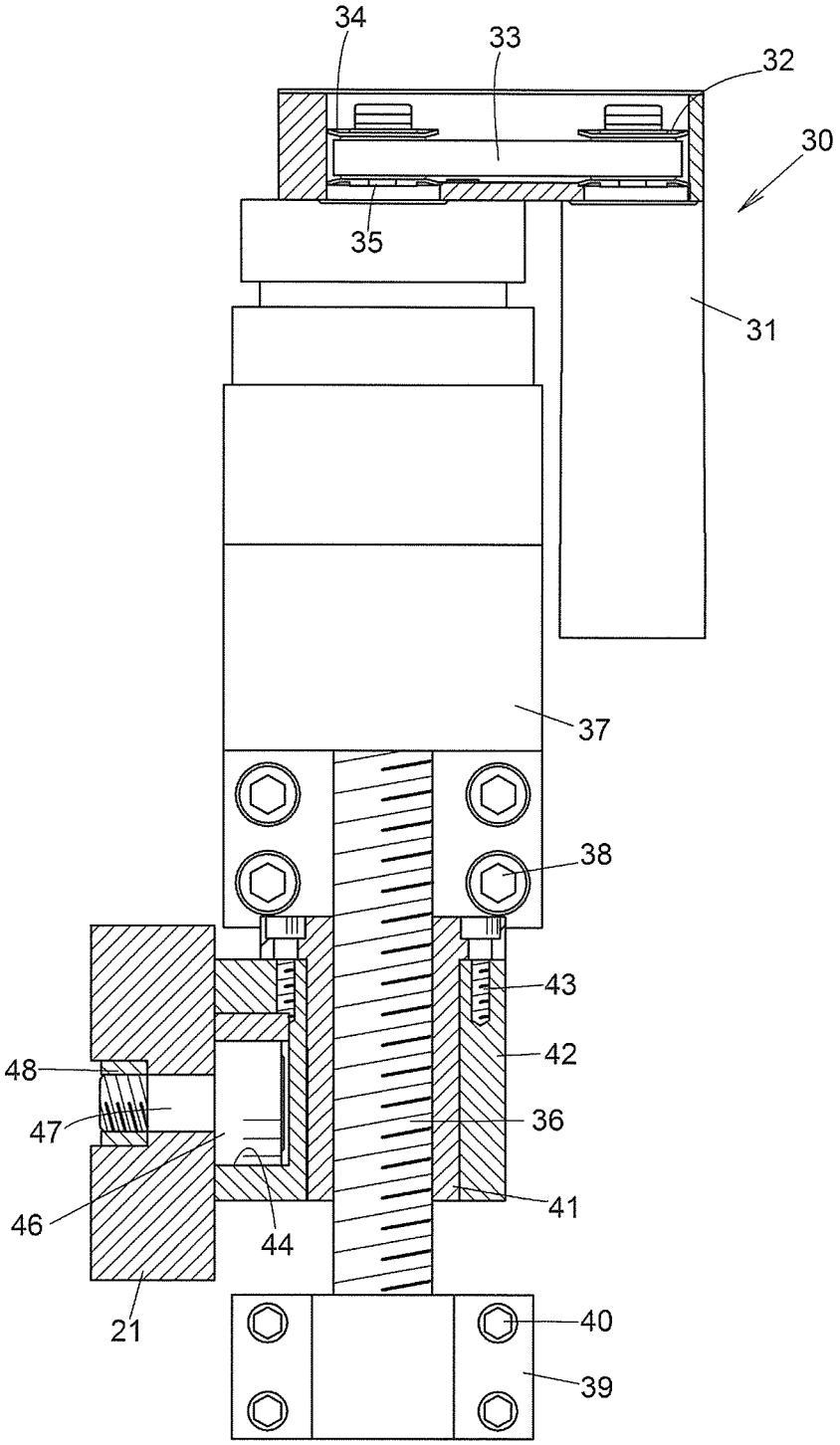
FIG. 5 is a partial sectional view showing a driving mechanism of inclined-shaft adjusting means (an A shaft).

Therefore, the rear surface of the round die table 21 slides to be turnable on a turning sliding surface 65 on the front surface of the moving headstock 50. The turning of the round die table 21 is driven by a desired angle amount by controlling an inclined-shaft control motor 31 which is numerically rotation-angle-controllable (see FIG. 5). The inclined-shaft control motor 31 is mounted on the moving headstock 50. The inclined-shaft control motor 31 performs, with a screw-feed driving mechanism driven by the inclined-shaft control motor 31, turning driving on the inclined shaft (the A shaft) of the round die table 21. The screw-feed driving mechanism is configured by a ball screw that can accurately perform a feeding motion. FIG. 5 is a sectional view showing the screw-feed driving mechanism of the inclined-shaft control motor 31. A timing pulley (a toothed pulley) 32 is fixed to an output shaft of the inclined-shaft control motor 31. On the other hand, a timing pulley (a toothed pulley) 34 is fixed to a ball-screw driving shaft 35 coupled to a ball screw 36. A timing belt (a toothed belt) 33 is laid over between the timing pulley 32 and the timing pulley 34. The ball-screw driving shaft 35 is decelerated via the reduction gear (not shown in the figure). The output shaft of the reduction gear and the ball screw 36 are coupled by a coupling.

The ball screw 36 is rotatably supported by a bearing in a bearing bracket 37. The distal end of the ball screw 36 is also rotatably supported by a bearing in a bearing bracket 39. The bearing bracket 37 is fixed to the B-shaft swinging table 60 (see FIG. 8) in the moving headstock 50 by bolts 38. The bearing bracket 39 is also supported by and fixed to the—shaft swinging table 60 by bolts 40. A ball nut 41 is screwed onto the ball screw 36. A cam follower bracket 42 of the ball nut 41 is fixed by bolts 43. A cam follower groove 44 is formed in the cam follower bracket 42. The direction of the groove of the cam follower groove 44 is a Z-axis direction.

A cam follower 46 rotatably supported by a roller is inserted into the cam follower groove 44. The cam follower 46 rolls in the cam follower groove 44 (the Z-axis direction). A supporting shaft 47 of the cam follower 46 is fixed to the round die table 21 by a nut 48. As it is understood from the above explanation of the structure, the round die table 21 turns about the A shaft according to the rotation driving of the inclined-shaft control motor 31. That is, when the inclined-shaft control motor 31 is driven to rotate, the reduction gear, the timing pulley 32, the timing belt 33, the timing pulley 34, the ball-screw driving shaft 35, and the ball screw 36 are driven. According to the rotation of the ball screw 36, the ball nut 41 screwed in the ball screw 36 moves in the up-down direction (the up-down direction in FIG. 5).

According to the up-down movement of the ball nut 41, the cam follower groove 44 also moves up and down. The cam follower 46 inserted into the cam follower groove 44 is also driven to move in the up-down direction while slightly rolling in the cam follower groove 44. The round die table 21 fixed to the cam follower 46 is turned in the A shaft according to the up-down movement of the cam follower 46. As it is understood from this explanation, the cam follower 46 can roll in the cam follower groove 44. Therefore, a radial position of the cam follower 46, that is, a radial position centering on the shaft 63 shown in FIG. 8 changes in the cam follower groove 44, whereby the round die table 21 can perform a smooth turning motion about the shaft 63 on the B-shaft swinging table 60.

[Taper-Shaft Adjusting Means (a B Shaft) Mounted on the Moving Headstock 50]

Figure 6:
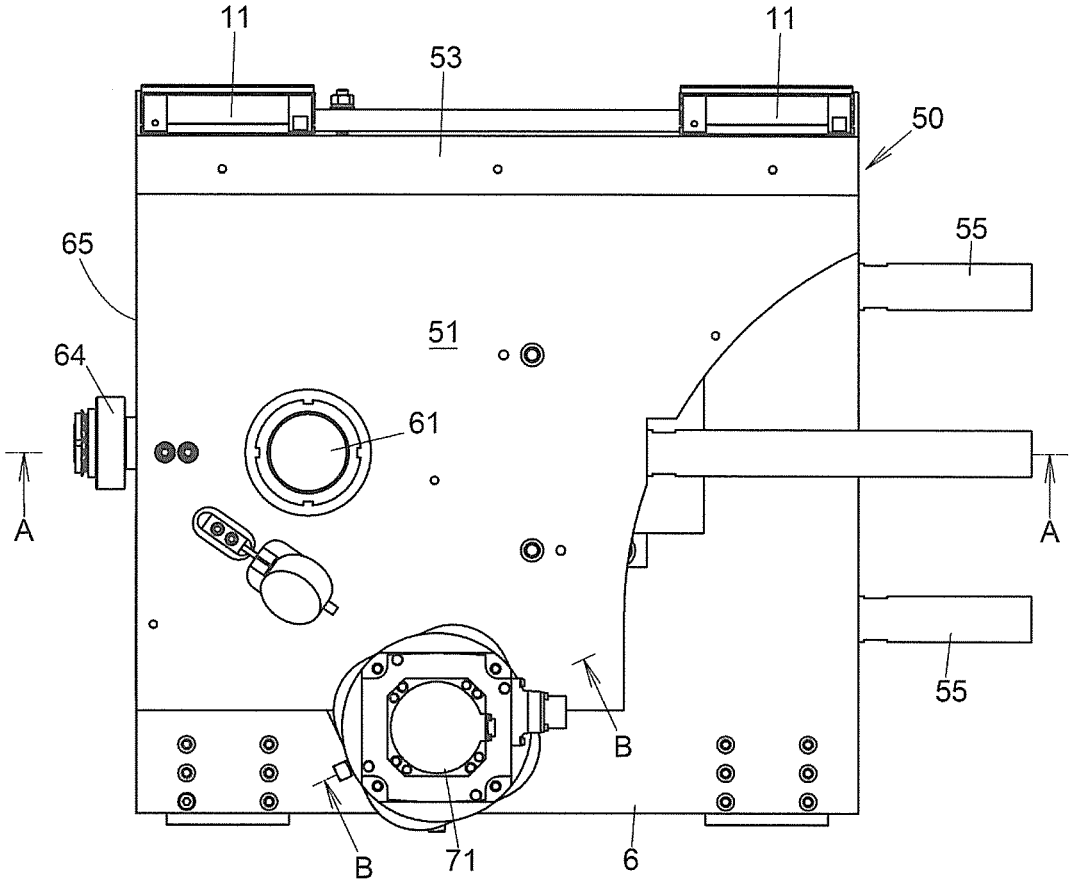
FIG. 6 is a plan view of the moving headstock mounted with the round die.
Figure 7:
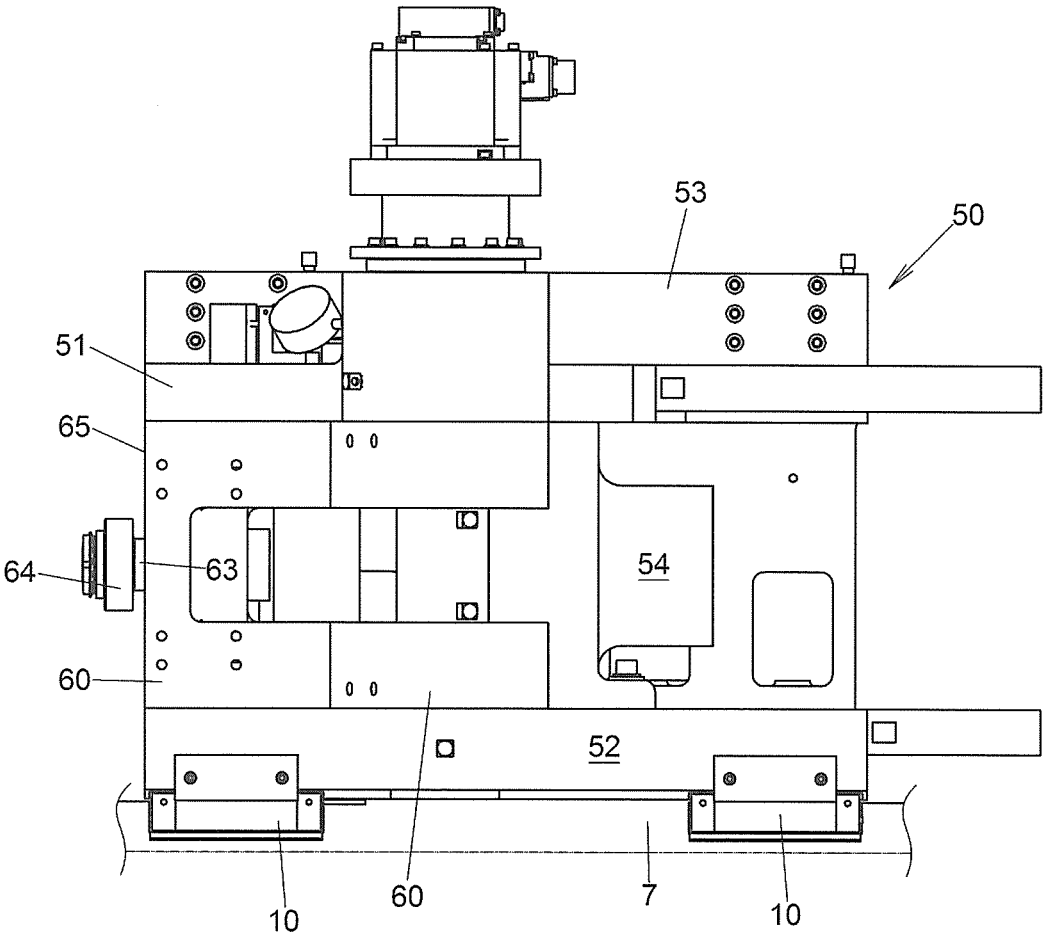
FIG. 7 is a front view of FIG. 6.
Figure 8:
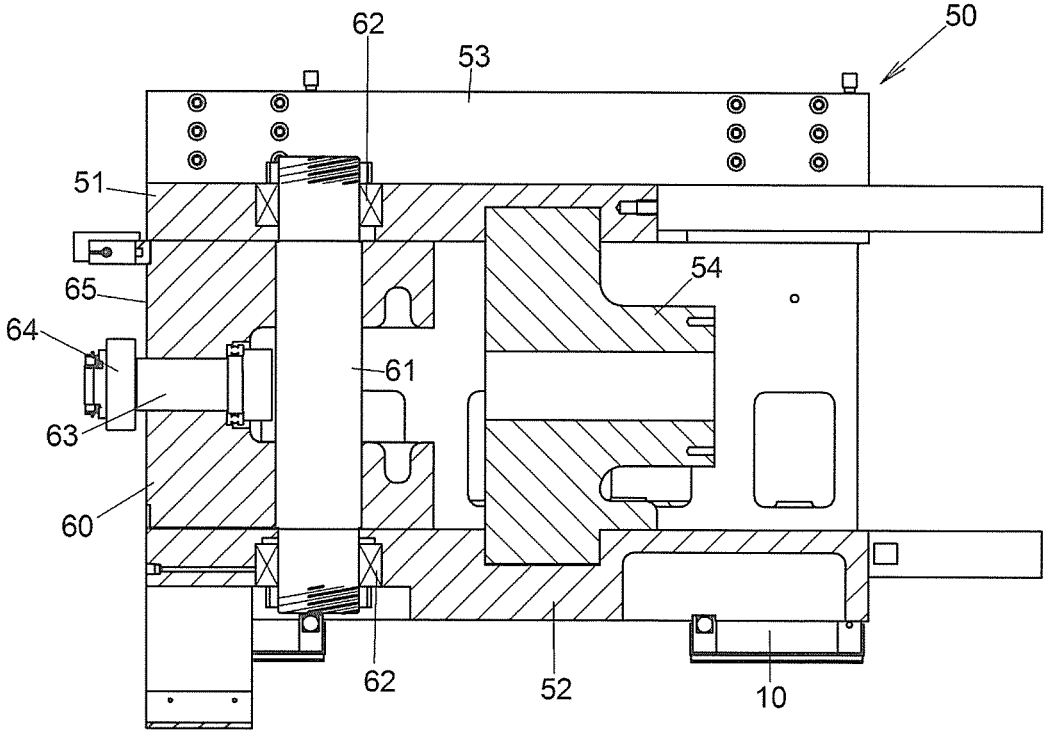
FIG. 8 is a sectional view of FIG. 6 taken along an A-A line.

Taper-shaft adjusting means (a B shaft) is angle adjusting means for adjusting a turning angle about a taper shaft (a B shaft) turned around a Y axis orthogonal to the push-in direction (the X-axis direction) of the round die 3 and orthogonal to the axis of a raw material to be rolled. Details of the taper-shaft adjusting means are explained below. FIG. 6 is a plan view of the moving headstock 50 viewed from above. FIG. 7 is a front view of FIG. 6. FIG. 8 is a sectional view of FIG. 6 taken along an A-A line. The moving headstock 50 is also a frame for receiving a push-in pressure from the ball screw 36, transmitting the push-in pressure to the round die 3, and turnably supporting the B-shaft turning table 60. As explained above, the moving headstock 50 is generally configured from the upper frame 51, the lower frame 6, and the side-surface guiding section 53.

The upper frame 51 and the lower frame 6, which are tabular members, are disposed vertically in parallel (in the vertical direction). The side-surface guiding section 53 that couples the upper frame 51 and the lower frame 6 is disposed and fixed on side surfaces of the upper frame 51 and the lower frame 6. The slider 11 provided in the side-surface guiding section 53 is guided by the linear guide rail 9 disposed and fixed on the sub-bed 8. A ball nut receiver 54 is fixedly disposed between the upper frame 51 and the lower frame 6. The ball nut receiver 54 is a member for receiving a push-in force in the X-direction from the ball nut 41 and transmitting the push-in force to the upper frame 51 and the lower frame 6. Eventually, the upper frame 51, the lower frame 6, and the ball nut receiver 54 are an integral structure.

The B-shaft swinging table 60 is disposed between the upper frame 51 and the lower frame 6 (see FIG. 7). The B-shaft swinging table 60 is a supporting table for mounting the round die table 21 and is a table for turning the round die table 21 around the B shaft. The B-shaft swinging table 60 is attached to be capable of turning about a shaft 61, that is, capable of turning in the moving headstock 50 about the B shaft. Therefore, upper and lower parts of the shaft 61 are respectively rotatably supported on the upper frame 51 and the lower frame 6 by a bearing 62 (see FIG. 8).

The shaft 63 explained above is rotatably supported on the front surface of the B-shaft swinging table 60 by a bearing. The center line of the shaft 63 rotates around the X axis. That is, the shaft 63 configures the A shaft. The center line of the shaft 63 substantially coincides with the center line of a ball screw that drives the X axis. Therefore, a driving force of the ball screw can be directly transmitted to the round die 3 in the X-axis direction. A bearing 64 is provided at an end portion on the front surface of the shaft 63. The bearing 64 is inserted into the rear surface of the round die table 21 and supports turning of the A shaft in a turning direction of the X axis.

[Driving Mechanism 70 for the B Shaft]

Figure 9:
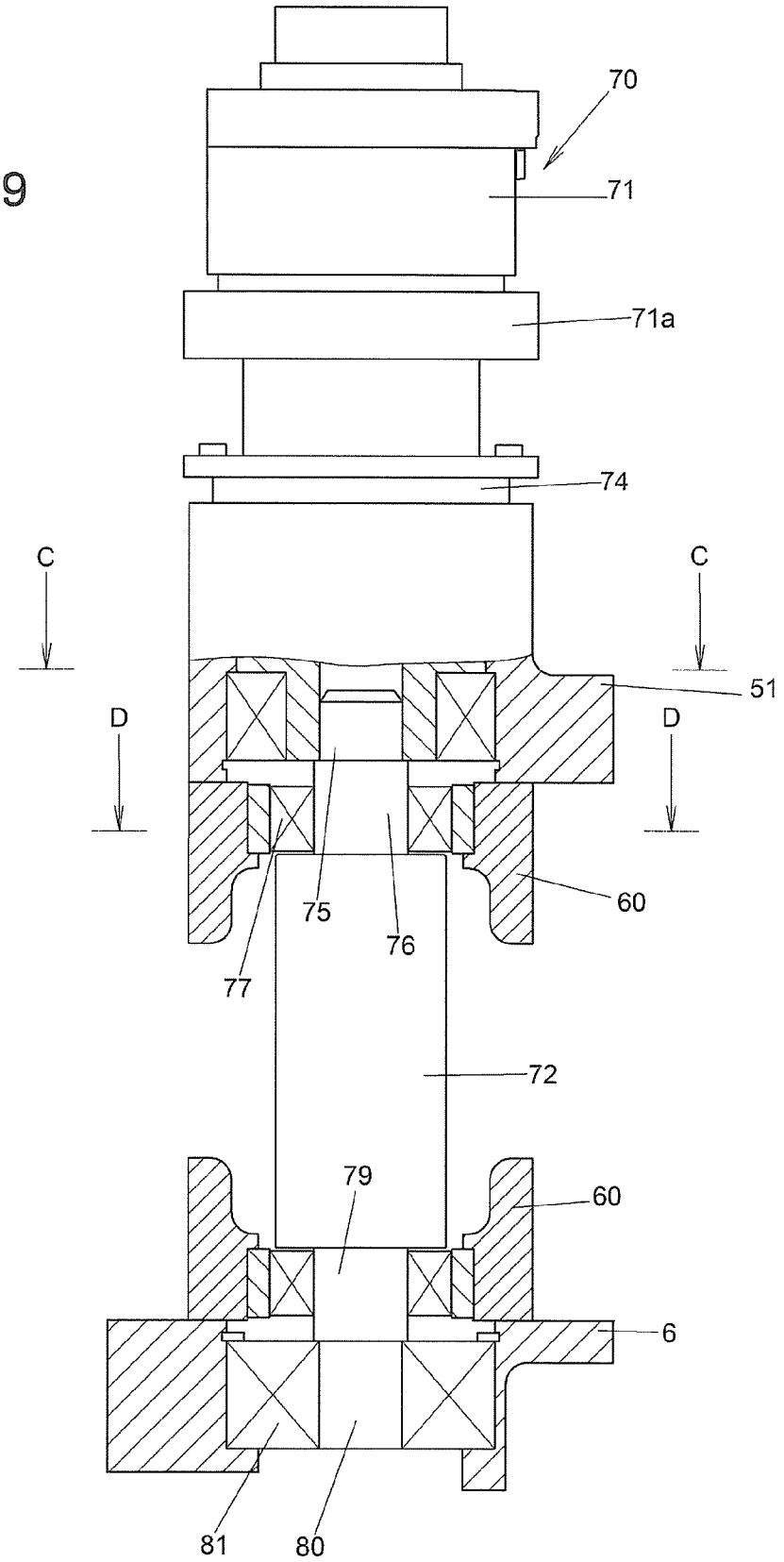
FIG. 9 is a sectional view of FIG. 6 taken along a B-B line.
Figure 10:
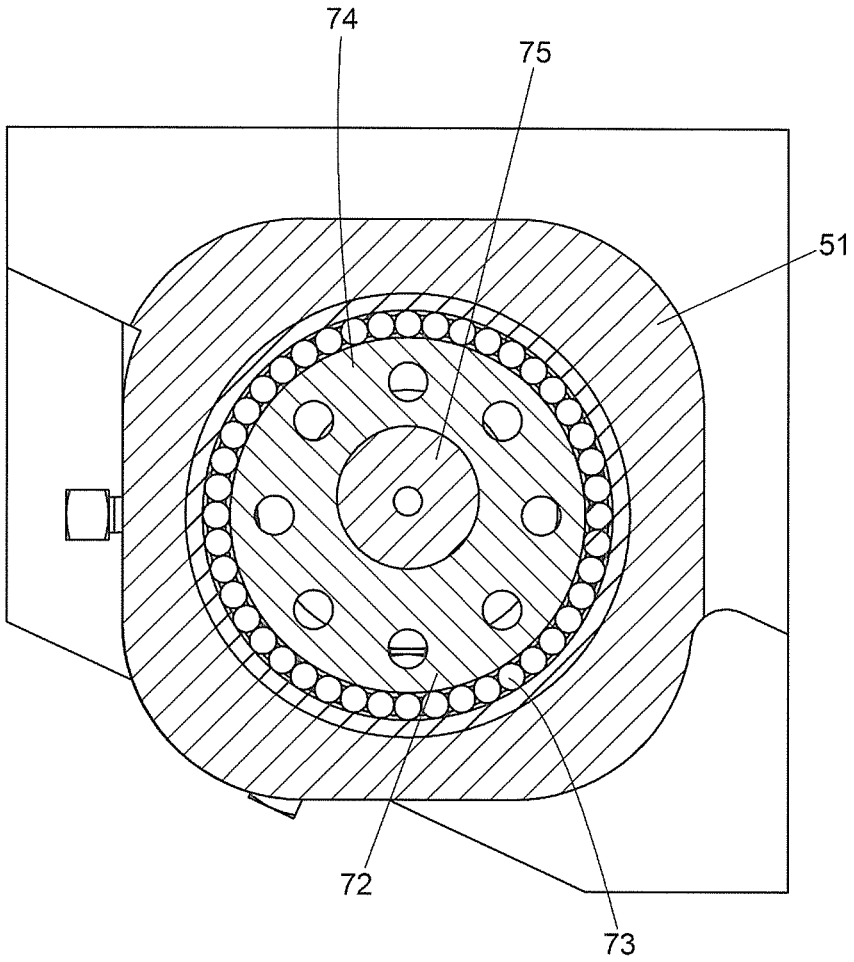
FIG. 10 is a sectional view of FIG. 9 taken along a C-C line.
Figure 11:
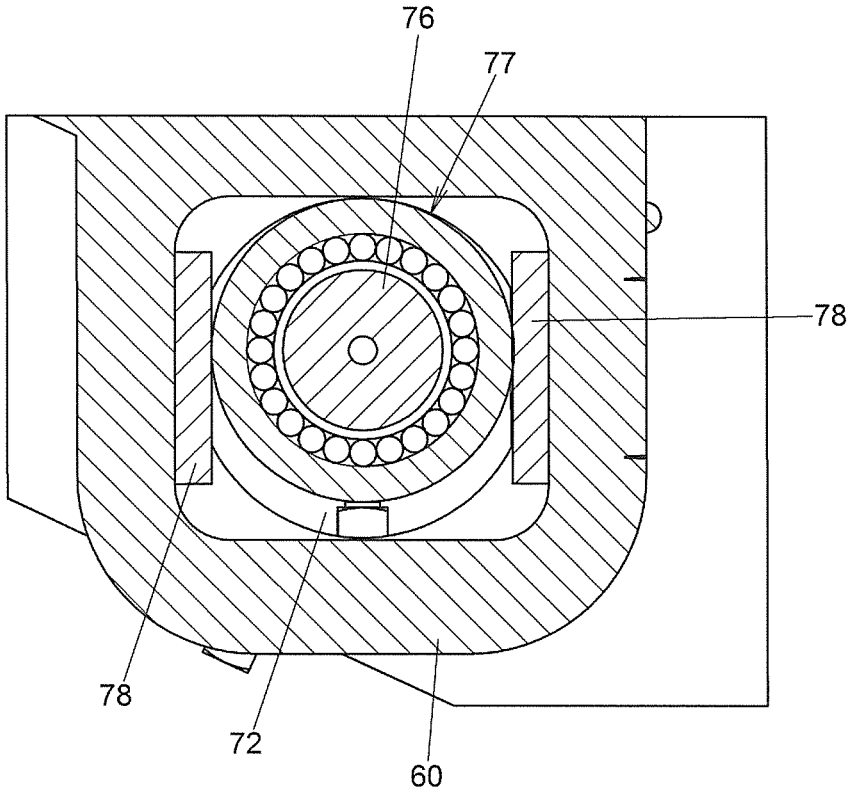
FIG. 11 is a sectional view of FIG. 9 taken along a D-D line.

A driving mechanism 70 for the B shaft is explained. FIG. 9 is a partial sectional view of FIG. 6 taken along a B-B line. FIG. 10 is a sectional view of FIG. 9 taken along a C-C line. FIG. 11 is a sectional view of FIG. 9 taken along a D-D line. As in the case of the A shaft, a numerically rotation-angle-controllable B-shaft control motor 71 is fixed and mounted on the upper surface of the upper frame 51 of the moving headstock 50 via a reduction gear 74 and a motor bracket 71*a*. An output shaft of the B-shaft control motor 71 is coupled to a driving B shaft 72 via the reduction gear 74 and an eccentric ring. An upper part 75 of the shaft 72 is rotatably supported on the upper frame 51 by a bearing 73. As shown in FIG. 10, an inserting section 75 at the upper end of the driving B shaft 72 is coupled to an output shaft of the B-shaft control motor 71, the reduction gear 74, and the eccentric ring.

On the other hand, as shown in FIG. 9 to FIG. 11, a shaft portion 76 in the position of the B-shaft swinging table 60 of the driving B shaft 72 is slightly eccentric from the other portions (a large-diameter shaft portion of the driving B shaft 72, a shaft portion 80 at the bottom end, etc.). A roller follower 77 is rotatably supported in the outer circumference of the shaft portion 76. The roller follower 77 is disposed between sliding members 78 of the B-shaft swinging table 60 (see FIG. 11). The two sliding members 78 are integrally provided in the B-shaft swinging table 60 and disposed to have a parallel gap. The roller follower 77 is disposed in this gap. The roller follower 77 is slidable in the gap. A shaft portion 79 in a lower part of the driving B shaft 72 is also eccentric and slidably supported by the B-shaft swinging table 60 by the same supporting structure. Further, a shaft portion 80 at the bottom end of the driving B shaft 72 is rotatably supported by a bearing 81 in the lower frame 6 of the moving headstock 50. As it is understood from the structure explained above, when the driving B shaft 72 is driven to rotate by the B-shaft control motor 71, the eccentric shaft portions 76 and 79 drive the B-shaft swinging table 60 and turn the B-shaft swinging table 60 about the shaft 61.

[Driving Mechanism for the Round Die 4]

The round die 4 is opposed to and symmetrically arranged with the round die 3. Functions of rotation and turning of the round die 4 are substantially the same as the functions of the round die 3. Explanation of the structure and the functions of the round die 4 is omitted. However, the fixed headstock 5 mounted with the round die 4 is fixed on the bed 2. The fixed headstock 5 in this embodiment does not move. During rolling, the moving headstock 50 mounted with the round die 3 approaches the fixed headstock 5 to thereby perform the rolling. However, the fixed headstock 5 mounted with the round die 4 may also be configured to be movable in the X-axis direction, and the fixed headstock 5 and the moving headstock 50 mounted with the round die 3 may be caused to approach each other during the rolling.

[Work Supplying/Gripping Mechanism 90]

The rolling machine 1 includes, as shown in FIG. 1, between the round die 4 and the round die 3, a work supplying/gripping mechanism 90 for supplying a raw material to be rolled and gripping the raw material during rolling. The work supplying/gripping mechanism 90 is freely movable in the X-axis direction. That is, during the rolling, a position in the X-axis direction is not controlled. The position of the work supplying/gripping mechanism 90 is naturally specified by a rolling pressure in the X-axis direction of the round die 4 and the round die 3. The work supplying/gripping mechanism 90 includes a numerically rotation-angle-controllable rotation control motor 91. The rotation of the rotation control motor 91 is decelerated by a built-in reduction gear and transmitted to a collet chuck 92 that grips a workpiece. The collet chuck 92 is capable of releasing and gripping the workpiece by performing advancing and retracting movement control by controlling a fluid cylinder 93. These mechanisms are not the gist of the present invention and are publicly known. Therefore, details of the mechanisms are not explained.

In the case of a long workpiece, the center of the distal end of the workpiece is supported by a center 95 of a tailstock. In rolling of a gear, rotation control of a workpiece is often not performed. Therefore, the rotation control motor 91 does not drive to control the workpiece. Instead, both ends of the workpiece are gripped by both the centers or the work piece is gripped by the collet chuck 92 and is not connected to an output shaft of the rotation control motor 91.

[Rolling of a Gear]

Rolling of a spur gear using sintered metal as a raw material by the rolling machine 1 in this embodiment is explained. A tooth shape of a gear of a sintered alloy, which is a sintered gear, is formed close to that of a final product. A plastic flow is caused only in a surface layer close to a tooth surface to roll and mold the gear. Therefore, rotation control of a work piece is not performed, and the workpiece freely rotates. Rotation driving of the round die 3 and the round die 4 and the rotation of the X-axis control driving motor 16 are simultaneously controlled. Rolling is performed according to the control. A helix deviations of a machined gear is measured. As a result, if a difference from a desired shape of the crowning is unacceptable, the inclined-shaft adjusting means (the A shaft) 30 is actuated to perform necessary fine adjustment. The inclined-shaft control motor 31 is driven to rotate and the round die table 21 is turned in the A shaft to correct the crowing.

In the case of the helix deviations, similarly, the inclined-shaft control motor 31 is driven to rotate and the round die table 21 is turned in the A shaft to correct the helix deviations. In the case of an error in which the helix is tapered, the B-shaft control motor 71 is driven and the B-shaft swinging table 60 is turned about the shaft 61 to correct the round die 3 and the round die 4 in the B shaft. The configuration, in which an angle of the helix of the gear to be machined is corrected by automatically changing the directions of the dies of the A shaft and the B shaft by controlling to drive the control motor, has been explained hereinabove.

[Example of Helix Data]

Figure 12:
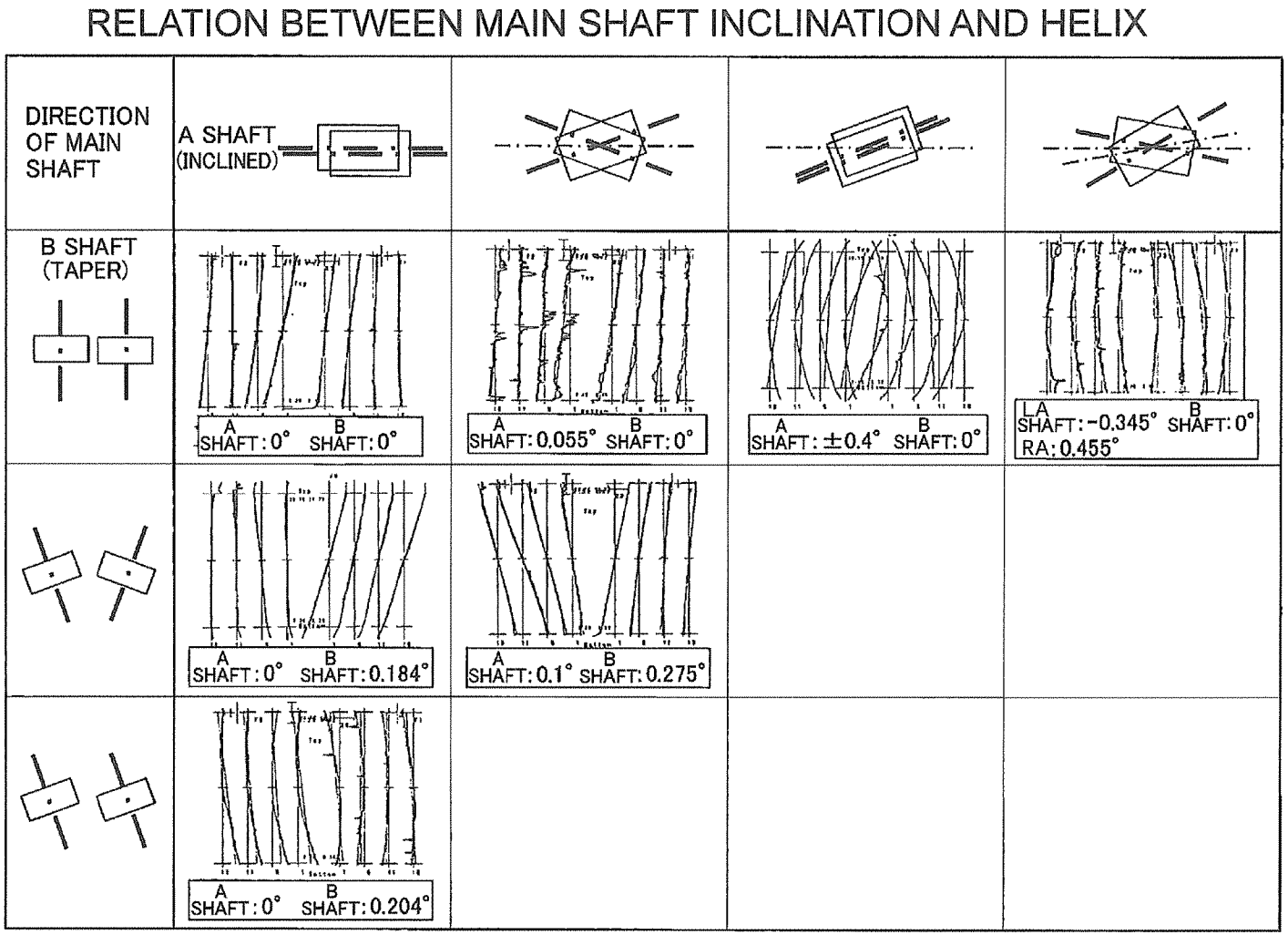
FIG. 12 is a data diagram showing a relation between a tilt of a die main shaft and a tooth trace of a gear.

FIG. 12 is a diagram showing a state of a tooth surface of a gear rolled by the rolling machine in this embodiment and showing an example of measured helix data. The measured helix data is measured data indicating helix in the case in which machining is performed by changing angles of the A shaft and the B shaft according to the directions of the two die shafts. The angles of the A shaft and the B shaft are adjusted by a very small amount. However, it has been proved that setting of a desired helix can be performed at will by the rolling machine 1 explained above.

Other Embodiments

It goes without saying that the configuration of the present invention is not limited to the embodiment explained above and may be other configurations. A plurality of examples are explained below concerning other embodiments. Since the A shaft and the B shaft are common in that both the shafts change the directions of round dies 3 and 4 (hereinafter referred to as dies) and change angles of the dies, the configuration applied to the A shaft is explained below. Therefore, since this configuration can also be applied to the B shaft, explanation of the B shaft is omitted.

All of configuration diagrams of figures referred to below are explanatory diagrams shown as partial diagrams of a portion where an angle is changed. In the explanation of the configuration, a supporting structure to which the dies can be attached to be turned is explained as a "die table" (in the embodiment explained above, equivalent to the round die table) and a supporting structure that supports the die table on the fixed side is explained as a "fixed table" (in the embodiment explained above, equivalent to the B-shaft swinging table). Both of motors for driving are numerically rotation-angle-controllable motors and are provided with reduction gears.

Another Embodiment 1

Figure 13:
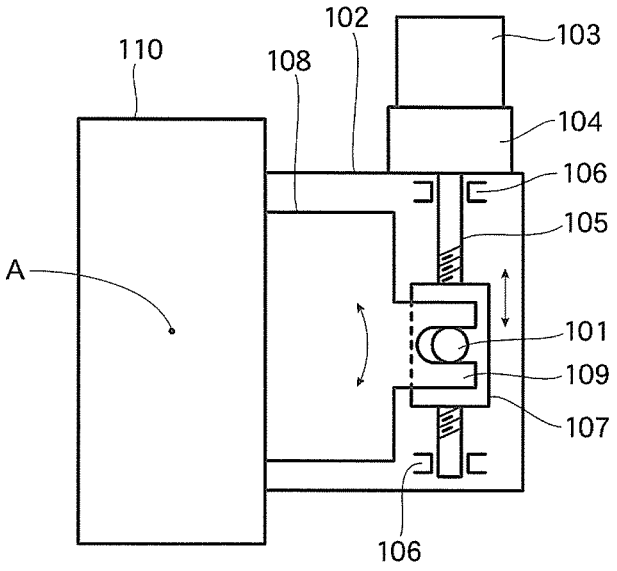
FIG. 13 is an explanatory diagram of a configuration in which a die table is inclined by a cam follower in another embodiment.

FIG. 13 is a configuration example applied with a cam follower 101. A motor 103 is attached to a fixed table 102. A reduction gear 104 is coupled and attached to an output shaft of the motor 103. A ball screw 105 is rotated by driving of the motor 103. Both end portions of the ball screw 105 are rotatably supported by bearings 106. A nut body 107 meshes with the ball screw 105. The nut body 107 is movable in the axial direction of the ball screw 105 by being controlled by a very small amount. The cam follower 101 is provided in the nut body 107.

On the other hand, in the die table 108, a cam follower groove section 109, which is a groove formed in a forked shape, is provided. The cam follower 101 is inserted into and engaged with the cam follower groove section 109. When the nut body 107 is driven by the motor 103 and moves, the cam follower 101 integral with the nut body 107 drives the cam follower groove section 109. Since the cam follower groove section 109 is integral with the die table 108, the movement of the cam follower groove section 109 is a swinging motion about an A point. According to the swinging motion, the round die 3 is turned around the A point by a small angle in a direction indicated by an arrow. The motor 103 has a function of controlling a desired rotation angle according to numerical control and performing rotation driving and rotates the ball screw 105 via the reduction gear 104.

Figure 14:
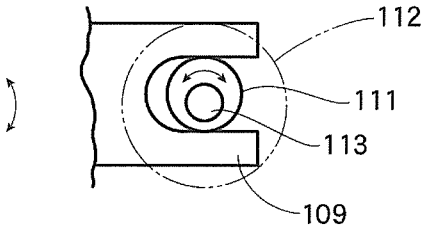
FIG. 14 is a modification of FIG. 13 and an explanatory diagram partially showing a configuration in which the die table is inclined by an eccentric cam.

In this way, a die 110 can change a setting angle in a range of a small angle that should be corrected according to the control by the motor 103. The die 110 is adapted to tooth trace correction machining of a gear according to the position change at the very small angle. The configuration of this example is similar to the configuration of the embodiment explained above. However, the configuration of this example is different from the configuration explained above in that the cam follower 101 is integral with the nut body 107 side and the cam follower groove section 109 is provided in the die table 108. The configuration of the embodiment partially shown in FIG. 14 is a modification in which an eccentric cam 111 is engaged with the cam follower groove section 109 having the same configuration. In the configuration of this case, an attachment position of the motor 112 is different and a ball screw is not provided. This is an example in which the eccentric cam 111 is provided in an output shaft 113 of the motor 103 via a reduction gear (not shown in the figure). In this example, the die table 108 is swung as indicated by an arrow in a range of an eccentric dimension of the eccentric cam 111 (a dimension difference of a circumferential portion with respect to a rotation center).

Another Embodiment 2

Figure 15:
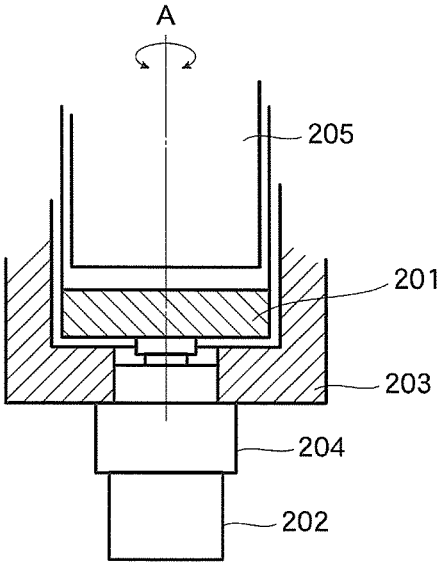
FIG. 15 is an explanatory diagram of a configuration in which driving of a motor is directly connected to incline a die table in another embodiment.

In this embodiment, as shown in FIG. 15, a die table 201 is directly connected to a driving body and rotated. A motor 202 is provided in a fixed table 203 along an A axis direction. A shaft end of the motor 202 is coupled to the die table 201 via a reduction gear mechanism 204. The motor 202 is numerically rotation-angle-controlled. The motor 202 can rotate a die 205 by a small angle via the reduction gear mechanism 204 involving rotation of a very small amount set to low speed. This configuration is a structurally simple configuration. However, since the motor 202 has to be attached on the inside of a rolling machine, an attachment position is restricted.

Another Embodiment 3

Figure 16:
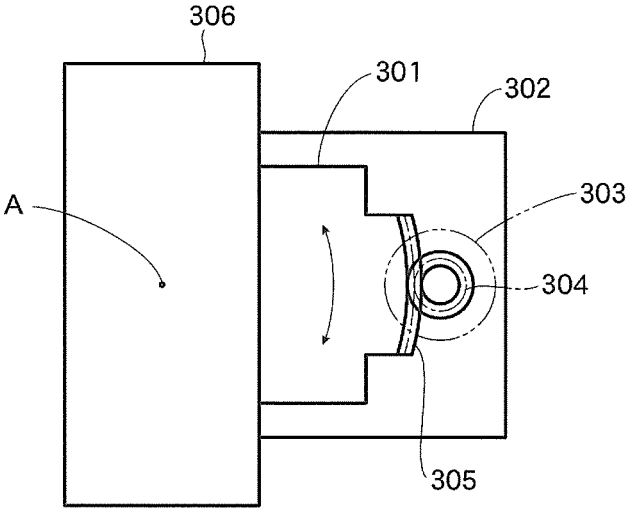
FIG. 16 is an explanatory diagram of a configuration in which a die table is inclined via a pinion gear in another embodiment.

In this configuration, as shown in FIG. 16, a die table 301 is turned via a gear mechanism. In this case as well, although not shown in the figure, a reduction gear is coupled and attached to an output shaft of the motor 303. A pinion 304 is attached to a shaft end of the motor 303 provided on a fixed table 302. The motor 303 is attached in a vertical direction of the figure. In one die table 301, a gear 305 is fixed to be integral with the die table 301 or formed integrally with the die table 301. The gear 305 is a sector gear having a shape including a teeth section in a part thereof. The teeth section meshes with the pinion 304. The rotation center of the gear 305 coincides with an A point of a die 306. Therefore, when the pinion 304 is rotated by a motor 303, which is numerically rotation-angle-controlled, via a not-shown reduction gear mechanism, the gear 305 also rotates and the die table 301 integral with the gear 305 swings about the A point as indicated by an arrow by a small angle.

Figure 17:
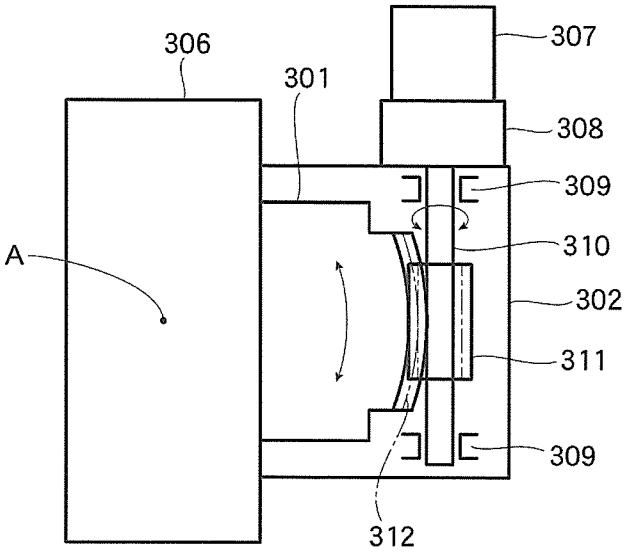
FIG. 17 is a modification of FIG. 16 and an explanatory diagram of a configuration in which the die table is inclined via a worm gear.

This gear mechanism may be a worn/worn wheel configuration shown in FIG. 17. A reduction gear 308 is coupled to an output shaft of a motor 307 provided on the fixed table 302. A worm shaft 310 is coupled to an output shaft of the reduction gear 308. Both ends of the worm shaft 310 are rotatably supported by bearings 309. A worm 311, which is a driving gear, is integrated with or fixed to the worm shaft 310. On the other hand, a worm wheel 312 is provided on the die table 301 integrally or as a separate member. The worm wheel 312 meshes with the worm 311. Like the gear explained above, the worm wheel 312 is a sector gear. The turning center of the worm wheel 312 coincides with the center A of the die 306. As explained above, the worm 311 is rotated by the motor 307, which is numerically rotation-angle-controlled, via the reduction gear 308, the worm wheel 312 meshing with the worm 311 rotates according to the rotation of the worm 311, and the die table 301 is swung a small angle with the A point as a fulcrum as indicated by an arrow.

Another Embodiment 4

Figure 18:
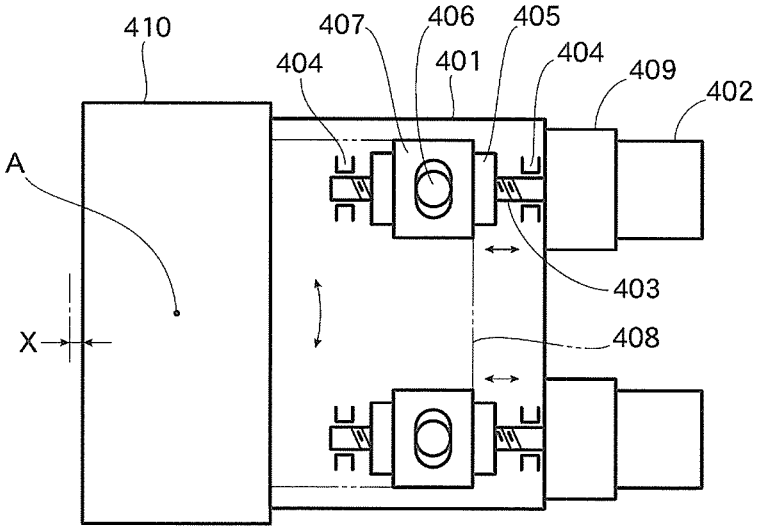
FIG. 18 is an explanatory diagram of a configuration in which a die table is inclined by driving of two motors in another embodiment.

In this configuration, as shown in FIG. 18, a reduction gear mechanism 409 is coupled to an output shaft of a motor 402, which is numerically rotation-angle-controlled. Two motors 402, which can be independently controlled, are disposed on a fixed table 401. A ball screw 403 is coupled to an output shaft of the motor 402. The ball screw 403 is rotatably supported by a bearing 404. A nut body 405 is screwed into the ball screw 403. A cam follower 406 is formed integrally with the nut body 405. The cam follower 406 is movably inserted into a cam follower groove member 407. Therefore, when the nut body 405 is driven by driving of the motor 402, the cam follower 406 integral with the nut body 405 moves, and the cam follower 406 turns the die table 408 via the cam follower groove member 407.

The nut body 405 moving in the axial direction meshes with the ball screw 403. The cam follower 406 is fixed to the nut body 405. The cam follower 406 is movably engaged with the cam follower groove member 407 integrally provided on the die table 408. In this configuration, two driving devices are disposed in parallel across an A point of a die 410. In this configuration, when the die table 408 is swung by a small angle as explained above, two motors 402 are synchronized and controlled to rotate in opposite directions to each other, whereby angle control is performed.

Since the control of the two motors can be individually performed, different kinds of control can be respectively performed for the two motors. Therefore, since play (backlash) can be prevented, it is possible to prevent a slight shift of a helix due to vibration or the like by maintaining a lock state. When the motors 402 are controlled to rotate in the same direction, it is possible to forcibly shift the A point position of the die 410 (see X in FIG. 18). This has a problem in design for enabling movement of the A point but is possible in terms of a configuration.

Another Embodiment 5

Figure 19:
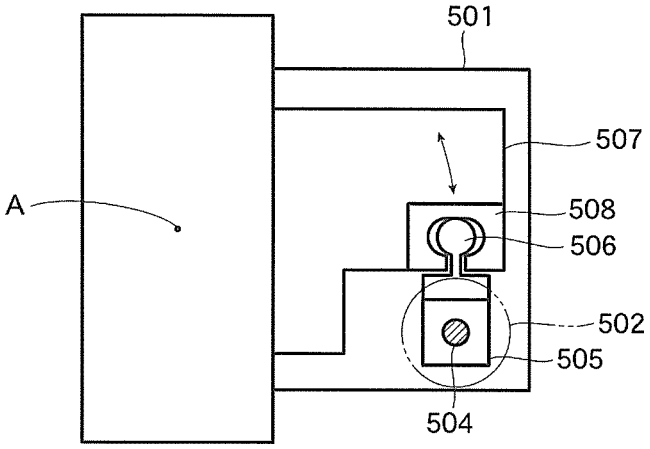
FIG. 19 is an explanatory diagram of a configuration in which a die table is inclined via a taper-like wedge mechanism in another embodiment.
Figure 20:
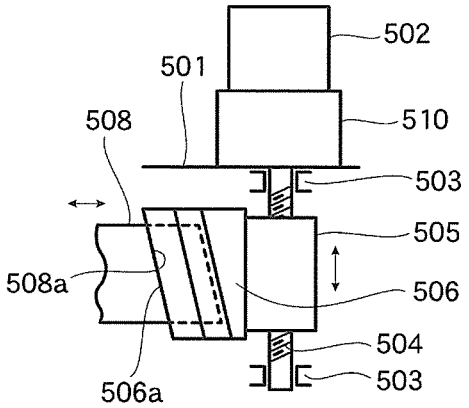
FIG. 20 is an explanatory diagram of a configuration in which a side surface of FIG. 19 is shown in a sectional view.

This configuration is a wedge structure as shown in FIG. 19 and FIG. 20. A ball screw 504 rotating via a bearing 503 is directly connected to a motor 502, which can be numerically rotation-angle-controlled, via a reduction gear 510 and supported on a fixed table 501. A nut body 505 meshes with the ball screw 504 and is capable of moving in an axial direction. A male engaging body 506 having a taper shape along a moving direction of the nut body 505 is integrally fixed to the nut body 505. On the other hand, on a die table 507, a taper-shaped female engaging body 508 engaging with the male engaging body 506 and having a substantially T groove is provided.

The male engaging body 506 fits in the female engaging body 508 and is capable of moving relative to each other along the taper shape via a slipping motion according to mutual contact of taper parts 506*a* and 508*a*. The male engaging body 506 moves together with a motion of the nut body 505 according to the rotation of the motor 502. Since engaging sections are tapered, the female engaging body 508 moves back and forth in a direction indicated by an arrow in a direction perpendicular to a moving direction of the nut body 505. Consequently, the die table 507 integral with the female engaging body 508 swings a small angle about a die A point as indicated by an arrow.

The engaging sections of the male engaging body 506 and the female engaging body 508 have different moving forms, that is, one linearly moves and the other turns, according to a positional shift in a taper direction. Therefore, according to a change in a position in the taper direction, a positional shift in a turning direction occurs simultaneously. Relief for facilitating the movement is required in design. The shape of the male engaging body 506 in this example is a round shape in section. However, the male engaging body 506 is not limited to this shape. Although not shown in the figure, in order to ensure this wedge effect, this wedge device may be provided to be spaced apart in a symmetrical position across the A point. In this case, a pressing direction of the male engaging body 506 against the female engaging body 508 is fixed to prevent backlash. In this case, the configuration is performed only in the pressing direction, and is therefore simplified.

Another Embodiment 6

Figure 21:
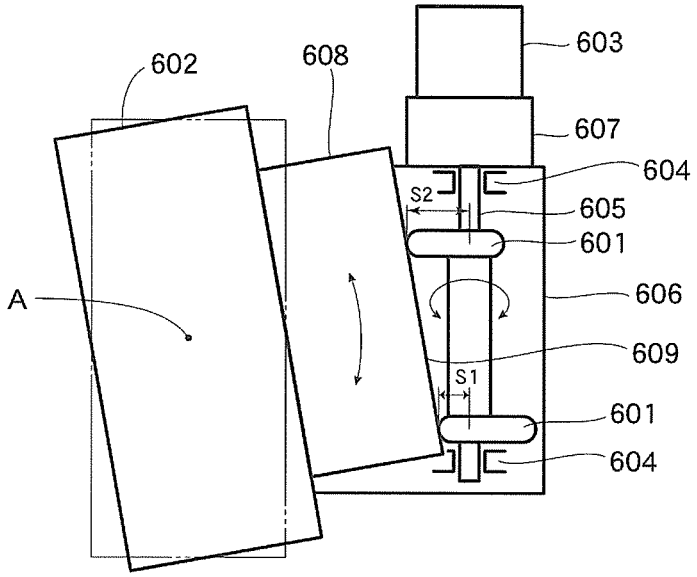
FIG. 21 is an explanatory diagram of a configuration in which two circular eccentric cams are spaced apart and brought into contact with a die table and the die table is inclined according to a rotating motion of the two circular eccentric cams in another embodiment.

In this configuration, two eccentric cams 601 are applied. A configuration shown in FIG. 21 is a structure in which two circular eccentric cams 601 having the same shape are linearly spaced apart and laid on top of the other like the shape shown in FIG. 22. The two circular eccentric cams 601 are disposed apart from each other at an equal distance from an A point of a die 602 and are driven by a motor 603. A driving shaft 605 is coupled to an output shaft of the motor 603. The driving shaft 605 is rotatably supported by bearings 604 disposed at both end portions of the driving shaft 605. The two circular eccentric cams 601 are coupled by a driving shaft 605. A numerically rotation-angle-controllable motor 603 is attached to a fixed table 606 via a reduction gear 607.

In the driving shaft 605 from the motor 603, the two circular eccentric cams 601 are provided to be spaced apart from each other. The two circular eccentric cams 601 integrally rotate in the same direction. On the other hand, on a die table 608, a contact surface 609 with which the two circular eccentric cams 601 are in contact is provided. The two circular eccentric cams 601 are always in contact with the contact surface 609. The two circular eccentric cams 601 are fixed to the driving shaft 605 with the directions thereof shifted 180 degrees in the radial direction from each other.

Figure 22:
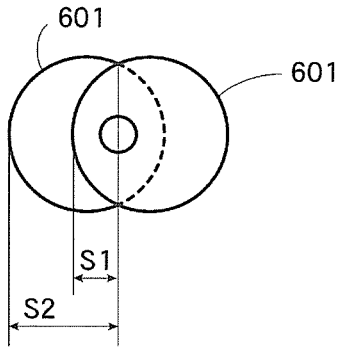
FIG. 22 is an explanatory diagram showing the shape of the circular eccentric cams shown in FIG. 21.

In FIG. 21, a major axis section of the circular eccentric cam 601 in an upper position on the motor 603 side is in contact with the contact surface 609 of the die table 608. A minor axis section of the circular eccentric cam 601 in a lower position is in contact with the contact surface 609 of the die table 608. Therefore, as shown in the figure, the die 602 turns by a difference S2−S1 between the major axis section and the minor axis section with the A point as a fulcrum and inclines a small angle. A die position indicated by an alternate long and two short dashes line is a normal parallel position. If a rotating position of the circular eccentric cam 601 is reversed, the die 602 inclines a small angle in the opposite direction. FIG. 22 is an explanatory diagram showing a configuration in a position where the shape of the circular eccentric cam is shifted 180 degrees.

Figure 23:
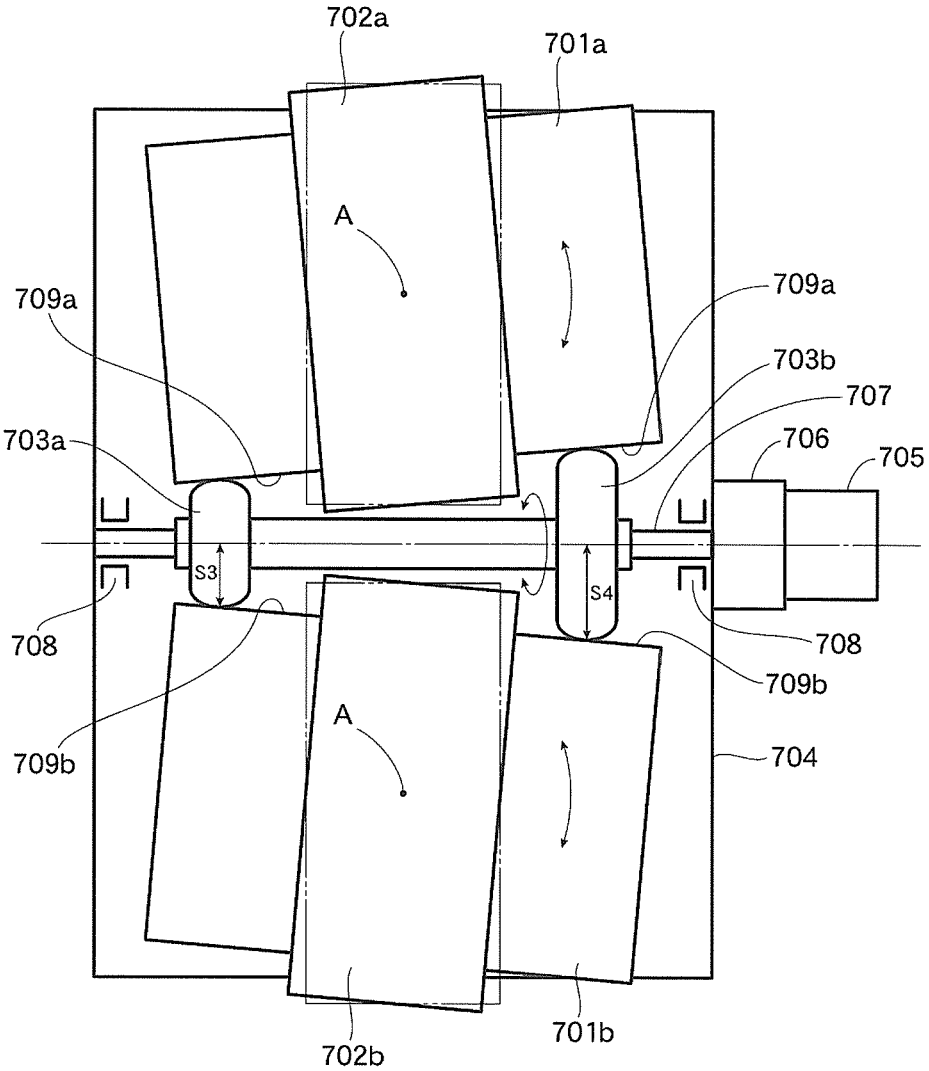
FIG. 23 is an explanatory diagram of a configuration in which two elliptical eccentric cams are spaced apart and brought into contact with two die tables and the two die tables are simultaneously inclined according to a rotating motion of the two elliptical eccentric cams in the other embodiment.
Figure 24:
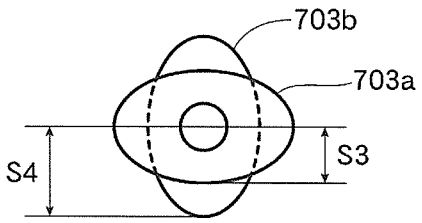
FIG. 24 is an explanatory diagram showing the shape of the elliptical eccentric cams shown in FIG. 23.

FIG. 23 is a diagram of a configuration corresponding to two die tables 701*a* and 701*b*. In the configuration, two cam members 703*a* and 703*b* are disposed an equal distance apart from each other in symmetrical positions between A points of two dies 702*a* and 702*b*. As shown in FIG. 24, the cam members 703*a* and 703*b* are cam members having the same shape and are cam members having an elliptical shape to which major axis sections and short axis sections are attached to be shifted from each other.

The cam members 703*a* and 703*b* having the same shape are disposed with the positions thereof shifted 180 degrees. Like the fixed table explained above, a numerically rotation-angle-controllable motor 705 is attached to a fixed table 704 via a reduction gear 706. A driving shaft 707 from the motor 705 is rotatably supported by a bearing 708. The two cam members 703*a* and 703*b* are fixed to be spaced apart with directions thereof turned 180 degrees.

On the other hand, the die tables 701*a* and 701*b* have contact surfaces 709*a* and 709*b* with which the cam members 703*a* and 703*b* are respectively in contact. The die tables 701*a* and 701*b* always maintain a contact state. According to the rotation of the cam members 703*a* and 703*b*, the die tables 701*a* and 701*b* symmetrically swing and incline. The configuration in FIG. 23 shows a state in which a major axis section of the cam member 703*b* on the motor 705 side is in contact and a minor axis section of the cam member 703*a* on an axis end side is in contact.

Therefore, the two dies 702*a* and 702*b* respectively incline a small angle in a direction of an arrow with the A points as fulcrums with respect to parallel die positions indicated by alternate long and two short dashes lines. In the inclination, as explained above, a difference in the turning of the dies 702*a* and 702*b* is a difference S4−S3 between the major axis sections and the minor axis sections. FIG. 24 is an explanatory diagram showing a configuration in which the position of the shape of the elliptical eccentric cam shown in FIG. 23 is shifted 180 degrees.

Another Embodiment 7

Figure 25:
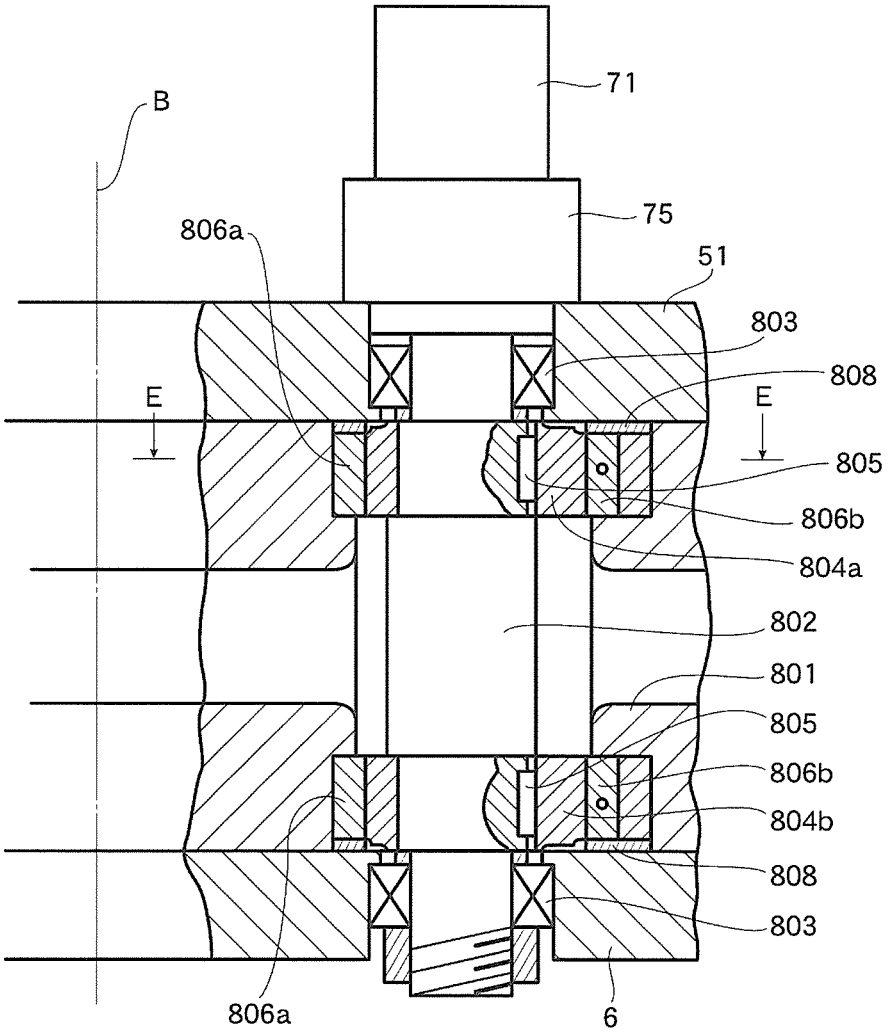
FIG. 25 shows a modification of a B-shaft swinging table and is a sectional view of a configuration in which a turning angle of a B shaft is adjusted by an eccentric cam in another embodiment.
Figure 26:
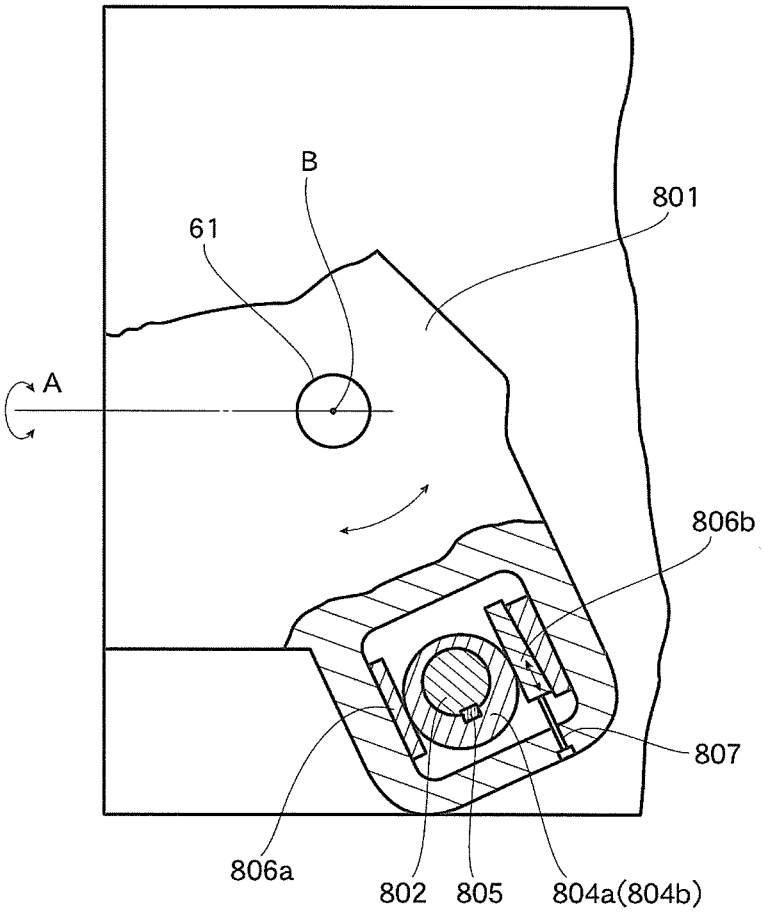
FIG. 26 is an E-E sectional view of FIG. 25.

A configuration in another embodiment 7 is a modification of the driving mechanism of the B shaft shown in FIG. 9 to FIG. 11. An example of the configuration is shown in FIG. 25 and FIG. 26. FIG. 25 is a sectional view of the configuration. FIG. 26 is an E-E sectional view of FIG. 25 and is a partial plan view corresponding to FIG. 6. A B-shaft swinging table 801 is held between the upper frame 51 and the lower claim frame 6. The B-shaft swinging table 801 is a supporting table on which the round die table 21 forming the configuration of the A shaft is mounted.

The B-shaft swinging table 801 is provided to be capable of turning about the shaft 61 (the B shaft). A shaft body 802 is rotatably provided piercing through the center portion of the B-shaft swinging table 801. One end portion of the shaft body 802 is coupled to the motor 71, which can be numerically rotation-angle-controlled, via a reduction gear 75. Both end portions of the shaft body 802 are supported by a frame via bearings 803. Two eccentric cams 804*a* and 804*b* are integrally fixed to both the end portions of the shaft body 802 in the same configuration via keys 805. Since the eccentric cams 804*a* and 804*b* involve wear, a material having high hardness compared with the other members is used.

On the other hand, in the B-shaft swinging table 801, two contact members 806*a* and 806*b* are provided to be opposed to each other and to be opposed to the eccentric cams 804*a* and 804*b*. Like the eccentric cams 804*a* and 804*b*, the contact members 806*a* and 806*b* are formed of a material having high hardness that can withstand wear. Both of the contact members 806*a* and 806*b* are fixed to the B-shaft swinging table 801 by bolts, and one contact member 806*b* is formed in a wedge configuration for performing interval adjustment.

That is, as shown in the figure, one contact member 806*b*, which is a wedge member, is inserted and pulled out in a direction of an arrow by a pushing and pulling member 807, whereby the interval between the two contact members 806*a* and 806*b* is adjusted according to the diameter of the circular eccentric cams 804*a* and 804*b*. When the shaft body 802 is rotated a small angle by the motor 71 via the reduction gear 74, the eccentric cams 804*a* and 804*b* change, while integrally rotating, eccentric positions according to the rotation and press the contact members 806*a* and 806*b*.

According to the pressing, the B-shaft swinging table 801 turns in a direction of an arrow with the B shaft as a fulcrum. According to the turning, it is possible to adjust the B-shaft swinging table 801 a small angle about the B shaft. In this example, liners 808 are provided on side surfaces of the contact members 806*a* and 806*b* to prevent a burr involved in a relative motion from occurring. In this example, the two eccentric cams 804*a* and 804*b* are provided on both sides of the shaft body 802. However, one eccentric cam may be provided in the center portion of the shaft body 802. In this example, since such a configuration by the eccentric cams 804*a* and 804*b* is adopted, in the motions of the eccentric cams 804 and 804*b*, stable turning without backlash can be performed. As a result, it is possible to accurately perform control of a turning angle of the B shaft.

In this way, as a matter common to all the embodiments explained above, the numerically rotation-angle-controllable motor is applied. Therefore, as change amounts caused by associated motions involved in the rotation of the motor, all positions and angles of the motor can be numerically grasped by calculation. Therefore, turning angles of the A shaft and the B shaft can be automatically controlled at an accurately digitized angle even if the turning angle is a small angle.

The invention claimed is:

1. A gear rolling machine comprising:

a plurality of cylindrical round dies disposed centering on a raw material, which is a workpiece, to roll the raw material from an outer circumference of the raw material;

die-rotation driving means for driving to rotate the round dies;

raw material supporting means for rotatably supporting the raw material; and push-in means for bringing the round dies close to each other from the outer circumference toward the raw material and pushing in the round dies while rotating the round dies in the same direction in synchronization with each other, the gear rolling machine further comprising:

a taper-shaft swinging table that swings on a taper shaft turning around a Y axis orthogonal to a push-in direction of the round dies;

a die table that swings on an inclined shaft turning around the push-in direction of the round dies on the taper-shaft swinging table;

taper-shaft adjusting means for adjusting a swing angle of the taper-shaft swinging table on the taper shaft;

inclined-shaft adjusting means for adjusting a swing angle of the die table on the inclined shaft; and the inclined-shaft adjusting means and the taper-shaft adjusting means are means for correcting a tooth trace and/or a tooth shape of a gear.

2. The gear rolling machine according to claim 1, wherein one of the round dies is mounted on a fixed headstock fixed on a bed, the other of the round dies is mounted on a moving headstock that moves on the bed, and guiding means on the bed of the moving headstock is a plurality of linear guide mechanisms (7, 7, 9) having different heights in a vertical direction.

3. The gear rolling machine according to claim 2, wherein the plurality of linear guide mechanisms (7, 7, 9) are disposed at an equal distance from a position of a power point in the push-in direction.

4. The gear rolling machine according to claim 1, further comprising work-rotation driving means for rotating the raw material in synchronization with a rotation driving of the round dies to control driving of rotation of the raw material around an axis of the raw material.

5. The gear rolling machine according to claim 1, wherein the inclined-shaft adjusting means and/or the taper-shaft adjusting means includes a screw shaft (105, 403) driven by a numerically rotation-angle-controllable motor (103) disposed on a fixed side, and is configured to bring a cam member (101, 406), which operates integrally with a moving object (107, 405) screwed into the screw shaft (105, 403) and movable in an axial direction according to rotation of the screw shaft (105, 403), into contact with the die table (108, 408) or the taper-shaft swinging table (60) to numerically adjust a direction of the round dies.

6. The gear rolling machine according to claim 1, wherein the inclined-shaft adjusting means and/or the taper-shaft adjusting means includes a first shaft (76, 113, 802) driven to rotate by a numerically rotation-angle-controllable motor (71, 112) disposed on a fixed side, and is configured to bring an eccentric cam member (77, 111, 804*a*, 804*b*), which operates according to a rotation driving of the first shaft (76, 113, 802), into contact with a cam follower (78, 109, 806*a*, 806*b*) integral with the die table (21) or the taper-shaft swinging table (60, 801) to numerically adjust a direction of the round dies.

7. The gear rolling machine according to claim 1, wherein the inclined-shaft adjusting means and/or the taper-shaft adjusting means includes gear transmission means (304, 305, 311, 312) driven by a numerically rotation-angle-controllable motor (303, 307) disposed on a fixed side, and is configured to rotate the die table (301) or the taper-shaft swinging table (60) according to a rotating motion of the gear transmission means (304, 305, 311, 312) to numerically adjust a direction of the round dies.

8. The gear rolling machine according to claim 1, wherein the inclined-shaft adjusting means and/or the taper-shaft adjusting means includes a screw shaft (504) driven by a numerically rotation-angle-controllable motor (502) disposed on a fixed side, includes a taper member (506, 508) screwed into the screw shaft (504) and capable of advancing and retracting according to rotation of the screw shaft (504), and is configured to press the die table (507) or the taper-shaft swinging table (60) according to a moving motion of the taper member (506, 508) to numerically adjust a direction of the round dies.

9. The gear rolling machine according to claim 1, wherein the inclined-shaft adjusting means and/or the taper-shaft adjusting means includes a second shaft (605, 707) driven by a numerically rotation-angle-controllable motor (603, 705) disposed on a fixed side, is provided with, in the second shaft (605, 707), two eccentric members (601, 703*a*, 703*b*) coming into contact with the die table (608, 701*a*, 701*b*) and spaced apart in an axial direction, and is configured to rotate the eccentric members (601, 703*a*, 703*b*) according to rotation of the second shaft (605, 707) to change an eccentric distance, and press the die table (608, 701*a*, 701*b*) or the taper-shaft swinging table (60) to numerically adjust a direction of the round dies.

10. A method of gear rolling a gear by a rolling machine including:

a plurality of cylindrical round dies disposed centering on a raw material, which is a workpiece, to roll the raw material from an outer circumference of the raw material;

die-rotation driving means for driving to rotate the round dies;

raw material supporting means for rotatably supporting the raw material; and push-in means for bringing the round dies close to each other toward the raw material and pushing in the round dies while rotating the round dies in the same direction in synchronization with each other, the method comprising:

adjusting, in order to correct a tooth trace and/or a tooth shape of the gear, a turning angle on an inclined shaft turned around a push-in direction of the round dies; and adjusting a turning angle on a taper shaft turned around a Y axis orthogonal to an axis of the raw material.

11. The method of gear rolling a gear according to claim 10, wherein the raw material is rotated in synchronization with a rotation driving of the round dies and controlled to be driven.

* * * * *